US007434553B2

(12) United States Patent
Nakano

(10) Patent No.: US 7,434,553 B2
(45) Date of Patent: Oct. 14, 2008

(54) VARIABLE VALVE MECHANISM FOR ENGINE

(75) Inventor: Shuuji Nakano, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 448 days.

(21) Appl. No.: 11/146,028

(22) Filed: Jun. 7, 2005

(65) Prior Publication Data

US 2005/0274343 A1 Dec. 15, 2005

(30) Foreign Application Priority Data

Jun. 11, 2004 (JP) ..... 2004-174676

(51) Int. Cl.
*F01L 1/34* (2006.01)

(52) U.S. Cl. ..... 123/90.16; 123/90.17; 123/345

(58) Field of Classification Search ..... 123/90.15, 123/90.16, 90.17, 90.18, 90.12, 90.13, 345, 123/346, 347, 348; 464/1, 2, 160
See application file for complete search history.

(56) References Cited

U.S. PATENT DOCUMENTS

| | | | | |
|---|---|---|---|---|
| 6,230,675 | B1 * | 5/2001 | Kobayashi et al. | 123/90.15 |
| 6,425,357 | B2 * | 7/2002 | Shimizu et al. | 123/90.16 |
| 6,575,128 | B2 * | 6/2003 | Nakamura et al. | 123/90.16 |

FOREIGN PATENT DOCUMENTS

| | | | |
|---|---|---|---|
| DE | 196 53 231 | A1 | 6/1998 |
| DE | 601 08 290 | | 1/2006 |
| JP | A-11-324740 | | 11/1999 |
| JP | A-2000-328911 | | 11/2000 |
| JP | A-2001-263015 | | 9/2001 |
| JP | A-2002-89215 | | 3/2002 |
| JP | 2002/242626 | A | 8/2002 |

OTHER PUBLICATIONS

German Language Version of German Office Action, Appln. No. 10 2005 026 950.8 issued Mar. 29, 2007.
German Translation of German Office Action, Appln. No. 10 2005 026 950.8 issued Mar. 29, 2007.
Japanese Language Version of Japanese Office Action, Appln. No. JP 2004-174676 issued on Aug. 28, 2007.
English Translation of Japanese Office Action, Appln. No. JP 2004-174676 issued on Aug. 28, 2007.

* cited by examiner

*Primary Examiner*—Ching Chang
(74) *Attorney, Agent, or Firm*—Kenyon & Kenyon LLP

(57) ABSTRACT

In a variable valve mechanism, a control shaft is associated with an advance oil passage such that the same passage is closed by the control shaft when a maximum valve lift amount of an intake valve is equal to or larger than a reference lift amount. The control shaft is associated with the advance oil passage such that a range in which the control shaft displaces is limited to a range between a minimum value of the maximum valve lift amount and a lift amount just before the reference lift amount when an advance angle of the intake valve is equal to or larger than a reference advance angle.

20 Claims, 24 Drawing Sheets

(b)

VARIABLE VALVE MECHANISM FOR ENGINE

INCORPORATION BY REFERENCE

The disclosure of Japanese Patent Application No. 2004-174676 filed on Jun. 11, 2004, including the specification, drawings and abstract are incorporated herein by reference in its entirety.

BACKGROUND OF THE INVENTION

1. Field of Invention

The invention relates to a variable valve mechanism for an engine provided with a maximum valve lift amount variable mechanism that changes a maximum valve lift amount of an engine valve (at least one of an intake valve and an exhaust valve), and a valve timing variable mechanism that changes a valve operation timing (valve timing).

2. Description of Related Art

A publication of Japanese Patent Application Laid-Open No. 2001-263015 discloses a known maximum valve lift amount variable mechanism for changing a maximum valve lift amount of an engine valve, which includes a control shaft that is movable in an axial direction, and a plurality of valve lift mechanisms provided thereon for changing the maximum valve lift amount of the engine valve.

In the aforementioned maximum valve lift amount variable mechanism, the control shaft is moved in the axial direction such that a relative phase difference between an input arm and an output arm provided in the valve lift mechanism is changed for adjusting the maximum valve lift amount of the engine valve.

Another publication of Japanese Patent Application Laid-Open No. 11-324740 discloses a known variable valve timing mechanism for changing a valve timing of an engine valve, which includes a vane rotor that can be rotated together with a cam shaft of the engine, and a housing that can be rotated together with a pulley or a sprocket of the engine such that an advance pressure chamber and a retardation pressure chamber are defined by the vane rotor and the housing.

In the above-structured variable valve timing mechanism, the amount of oil supplied to the respective pressure chambers is adjusted to change the rotary phase of the cam shaft relative to that of the crankshaft for changing the valve timing of the engine valve.

The variable valve mechanism provided with the maximum valve lift amount variable mechanism and the variable valve timing mechanism makes it possible to control the valve characteristics with a higher degree of freedom in accordance with an engine operation state.

Another publication of Japanese Patent Application Laid-Open No. 2000-328911 discloses a known variable valve mechanism provided with a maximum valve lift amount variable mechanism that changes the maximum valve lift amount of the engine valve by changing a cam among a plurality of cams each having a different lift amount.

The engine provided with the aforementioned variable valve mechanism may cause the piston to be in contact with the engine valve when the maximum valve lift amount or the valve timing is changed. For example, when the valve timing of the intake valve in the state where the advance angle is set to X1, and the maximum valve lift amount is set to Y is advanced to the advance angle X2, the piston is brought into contact with the intake valve.

The variable valve mechanism provided with the maximum valve lift amount variable mechanism and the variable valve timing mechanism is required to avoid the contact between the piston and the engine valve as aforementioned.

In the publication of Japanese Patent Application Laid-Open No. 2000-328911, when the cam with a large lift amount is selected, a pin that limits the advance angle of the valve timing variable mechanism is operated by a work fluid of the maximum valve lift amount variable mechanism so as to avoid the contact between the piston and the engine valve.

However, this system can not be applied to other variable valve mechanisms such as the one disclosed in Japanese Patent Application Laid-Open No. 2001-263015 due to the fundamental difference in the structure of this maximum valve lift amount variable mechanism.

SUMMARY OF THE INVENTION

It is an object of the invention to provide a variable valve mechanism for an engine, which is provided with a maximum valve lift amount variable mechanism that changes a maximum valve lift amount by moving a control shaft, and a variable valve timing mechanism that changes a valve timing by adjusting a supply amount of work fluid for avoiding a contact between a piston and an engine valve.

In the invention, an upper limit lift amount, an upper limit advance angle, a reference lift amount and a reference advance angle will be defined as follows.

The upper limit lift amount is defined as a maximum valve lift amount at an arbitrary advance angle located on a boundary between the maximum valve lift amount that causes the contact between the piston and the engine valve and the maximum valve lift amount that does not cause the contact between the piston and the engine valve. That is, when the maximum valve lift amount is smaller than the upper limit lift amount, the contact between the piston and the engine valve never occurs. Meanwhile when the maximum valve lift amount is equal to or larger than the upper limit lift amount, the contact between the piston and the engine valve occurs.

The upper limit advance angle is defined as an advance angle at an arbitrary maximum valve lift amount located on the boundary between the advance angle that causes the contact between the piston and the engine valve and the advance angle that does not cause the contact between the piston and the engine valve. That is, when the advance angle is smaller than the upper limit advance angle, the contact between the piston and the engine valve never occurs. Meanwhile when the advance angle is equal to or larger than the upper limit angle, the contact between the piston and the engine valve occurs.

The reference lift amount is defined as the lift amount that locates on the boundary between the maximum valve lift amount that does not cause the contact between the piston and the engine irrespective of the change in the advance angle to an arbitrary value and the maximum valve lift amount that causes the contact between the piston and the engine valve upon change in the advance angle to the value equal to or larger than the upper limit advance angle. That is, when the maximum valve lift amount is smaller than the reference lift amount, the contact between the piston and the engine valve does not occur even if the advance angle is changed to an arbitrary value. Meanwhile when the maximum valve lift amount is equal to or larger than the reference lift amount, the contact between the piston and the engine valve occurs upon the change in the advance angle to the value equal to or larger than the upper limit advance angle.

The reference advance angle is defined as the advance angle that locates on the boundary between the advance angle that does not cause the contact between the piston and the engine valve irrespective of the change in the maximum valve lift amount to an arbitrary value and the advance angle that causes the contact between the piston and the engine valve upon change in the maximum valve lift amount to the value equal to or larger than the upper limit lift amount. That is, when the advance angle is smaller than the reference advance angle, the contact between the piston and the engine valve does not occur even if the maximum valve lift amount is changed to an arbitrary value. Meanwhile when the advance angle is equal to or larger than the reference advance angle, the contact between the piston and the engine valve occurs upon the change in the maximum valve lift amount to the value equal to or larger than the upper limit lift amount.

The explanation as to how the invention is realized and the effect derived from the invention will be described hereinafter.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The control shaft is associated with the advance oil passage such that the advance oil passage is held closed by the control shaft when the control shaft is held on a position at which the maximum valve lift amount of the engine valve is equal to or larger than a reference lift amount. The advance oil passage is associated with the control shaft such that a control shaft operative range is limited to a range between a minimum value of the maximum valve lift amount and a lift amount just before the reference lift amount when an advance angle of the engine valve is equal to or larger than a reference advance angle.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The advance oil passage is closed by the control shaft when the maximum valve lift amount of the engine valve is equal to or larger than a reference lift amount, and the advance oil passage is opened by the control shaft when the maximum valve lift amount of the engine valve is smaller than the reference lift amount. A control shaft operative range is limited to a range between a minimum value of the maximum valve lift amount and a lift amount just before the reference lift amount through a work fluid flowing in the advance oil passage when an advance angle of the engine valve is equal to or larger than a reference advance angle, and a limitation of the control shaft operative range through the work fluid is released when the advance angle of the engine valve is smaller than the reference advance angle.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, a first advance oil passage that connects an oil groove that is formed in the control shaft and forms a part of the advance oil passage to a first communication hole formed in the work fluid supply source and the rocker shaft, a second advance oil passage that connects a second communication hole formed in the rocker shaft to the advance pressure chamber, and a lock mechanism for limiting a control shaft operative range, which includes a lock groove formed in the control shaft so as to extend in the axial direction, a restrictive oil passage that connects the first advance oil passage to a third communication hole formed in the rocker shaft, a lock pin provided in the restrictive oil passage and inserted into the lock groove through the third communication hole under depression force applied by the work fluid, and a bias mechanism provided in the restrictive oil passage so as to bias the lock pin to a direction opposite to a direction of the depression force applied by the work fluid. A structure of a path through which the work fluid flows is selected between conditions [A] and [B] in accordance with an axial position of the control shaft, and a limitation of the control shaft operative range by the lock pin is selected between conditions [C] and [D] in accordance with an advance angle of the engine valve:

[A] when the control shaft is held on a position at which the maximum valve lift amount of the engine valve is smaller than a reference lift amount, an oil groove of the control shaft is communicated with the first and the second advance oil passages so as to maintain an opened state of the advance oil passage, and a communication state between the lock groove and the restrictive oil passage;

[B] when the control shaft is held on a position at which the maximum valve lift amount is equal to or larger than the reference lift amount, the oil groove of the control shaft is not communicated with the first and the second communication holes so as to maintain a closed state of the advance oil passage, and a non-communication state between the lock groove and the restrictive oil passage;

[C] when an advance angle of the engine valve is equal to or larger than a reference advance angle, and the lock groove is communicated with the restrictive oil passage, a state in which the lock pin is inserted into the lock groove is maintained through the work fluid such that the control shaft operative range is limited to a range between a minimum value of the maximum valve lift amount and a lift amount just before the reference lift amount; and

[D] when the advance angle of the engine valve is smaller than the reference advance angle, a state in which the lock pin is not inserted into the lock groove is maintained through the bias mechanism such that the limitation of the control shaft operative range is released.

According to the aforementioned invention, the following effects will be obtained. When the maximum valve lift amount is equal to or larger than the reference lift amount, the advance oil passage is closed by the control shaft. That is, the valve timing cannot be advanced. When the maximum valve lift amount is equal to or larger than the reference lift amount, the advance angle cannot be changed to the value equal to or larger than the upper limit advance angle. Accordingly this makes it possible to avoid the contact between the piston and the engine valve owing to the change in the advance angle.

When the advance angle is equal to or larger than the reference advance angle, the control shaft movement range is limited to the range from the minimum value of the maximum valve lift amount to the lift amount just before the reference lift amount. That is, the maximum valve lift amount cannot be changed to the value equal to or larger than the reference lift amount. When the advance angle is equal to or larger than the reference advance angle, the maximum valve lift amount cannot be changed to the value equal to or larger than the upper limit lift amount. Accordingly this makes it possible to avoid the contact between the piston and the engine valve owing to the change in the maximum valve lift amount.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The control shaft is associated with the advance oil passage such that the advance oil passage is held closed by the control shaft held on a position at which the maximum valve lift amount of the engine valve is equal to or larger than a reference lift amount.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The advance oil passage is brought into a closed state by the control shaft when the maximum valve lift amount of the engine valve is equal to or larger than a reference lift amount, and the closed state of the advance oil passage is released when the maximum valve lift amount of the engine valve is smaller than the reference lift amount.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, a first advance oil passage that connects an oil groove that is formed in the control shaft and forms a part of the advance oil passage to a first communication hole formed in the work fluid supply source and the rocker shaft, and a second advance oil passage that connects a second communication hole formed in the rocker shaft to the advance pressure chamber. A structure of a path through which the work fluid flows is selected between conditions [A] and [B] in accordance with an axial position of the control shaft:

[A] when the control shaft is held on a position at which the maximum valve lift amount of the engine valve is smaller than the reference lift amount, an oil groove of the control shaft is communicated with the first and the second advance oil passages so as to maintain an opened state of the advance oil passage; and

[B] when the control shaft is held on a position at which the maximum valve lift amount is equal to or larger than the reference lift amount, the oil groove of the control shaft is not communicated with the first and the second communication holes so as to maintain a closed state of the advance oil passage.

According to the aforementioned invention, the following effects will be obtained. When the maximum valve lift amount is equal to or larger than the reference lift amount, the advance oil passage is closed by the control shaft. That is, the valve timing cannot be advanced. When the maximum valve lift amount is equal to or larger than the reference lift amount, the advance angle cannot be changed to the value equal to or larger than the upper limit advance angle. This makes it possible to avoid the contact between the piston and the engine valve owing to the change in the advance angle.

In the above-structured invention, the variable valve mechanism is provided with a controller that changes the maximum valve lift amount under a control of the control shaft, and the controller inhibits a change in the maximum valve lift amount of the engine valve to be equal to or larger than an upper limit lift amount when an advance angle of the engine valve is equal to or larger than a reference advance angle.

In the aforementioned structure, when the advance angle is equal to or larger than the reference advance angle, the maximum valve lift amount cannot be changed to the value equal to or larger than the upper limit lift amount. This makes it possible to avoid the contact between the piston and the engine valve owing to the change in the maximum valve lift amount.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The control shaft is associated with the advance oil passage such that a control shaft operative range is limited to a range between a minimum value of the maximum valve lift amount and a lift amount just before a reference lift amount when an advance angle of the engine valve is equal to or larger than a reference advance angle.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. A control shaft operative range is limited to a range between a minimum value of the maximum valve lift amount and a lift amount just before the reference lift amount through the work fluid that flows in the advance oil passage when an advance angle of the engine valve is equal to or larger than a reference advance angle, and a limitation of the control shaft operative range by the work fluid is released when the advance angle of the engine valve is smaller than the reference advance angle.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, and a lock mechanism for limiting a control shaft operative range, which includes a lock groove formed in the control shaft so as to extend in the axial direction, a restrictive oil passage that connects the first advance oil passage to the rocker shaft, a lock pin provided in the restrictive oil passage and inserted into the lock groove through a third communication hole under depression force applied by the work fluid, and a bias mechanism provided in the restrictive oil passage so as to bias the lock pin to a direction opposite to a direction of the depression force applied by the work fluid. A control of a limitation of the control shaft operative range performed by the lock pin is selected between conditions [A] and [B] in accordance with an advance angle of the engine valve:

[A] when an advance angle of the engine valve is equal to or larger than a reference advance angle, and the lock groove is communicated with the restrictive oil passage, a state in which the lock pin is inserted into the lock groove is maintained by the work fluid so as to limit the control shaft operative range to a range between a minimum value (Lmin) of the maximum valve lift amount; and

[B] when the advance angle of the engine valve is smaller than the reference advance angle, a state in which the lock pin is not inserted into the lock groove is maintained by the bias mechanism, so as to release the limitation of the control shaft operative range.

According to the aforementioned invention, the following effects will be obtained. When the advance angle is equal to or larger than the reference advance angle, the control shaft movement range is limited to the range between the minimum value of the maximum valve lift amount to the lift amount just before the reference lift amount by the work fluid that flows through the advance oil passage. That is, the maximum valve lift amount cannot be changed to the value equal to or larger than the reference lift amount. When the advance angle is equal to or larger than the reference advance angle, the maximum valve lift amount cannot be changed to the value equal to or larger than the upper limit lift amount. This makes it possible to avoid the contact between the piston and the engine valve owing to the change in the maximum valve lift amount.

In the above-structured invention, the variable valve mechanism is provided with a controller that changes the maximum valve lift amount under a control of the control shaft, and the controller inhibits a change in the advance angle of the engine valve to be equal to or larger than an upper limit advance angle when a maximum valve lift amount of the engine valve is equal to or larger than a reference lift amount.

In the aforementioned structure, when the maximum valve lift amount is equal to or larger than the reference lift amount, the advance angle cannot be changed to the value equal to or larger than the upper limit advance angle. This makes it possible to avoid the contact between the piston and the engine valve owing to the change in the advance angle.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The advance oil passage is associated with the control shaft such that a range in which an advance angle of the engine valve is changed is limited in accordance with the maximum valve lift amount, and a range in which the maximum valve lift amount is changed is limited in accordance with the advance angle of the valve timing so as to avoid a contact between a piston of the engine and the engine valve.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The advance oil passage is associated with the control shaft such that a range in which an advance angle of the engine valve is changed is limited in accordance with the maximum valve lift amount so as to avoid a contact between a piston of the engine and the engine valve.

A variable valve mechanism for an engine according to the invention is provided with a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber. The advance oil passage is associated with the control shaft such that a range in which the maximum valve lift amount is changed is limited in accordance with an advance angle of the valve timing so as to avoid a contact between a piston of the engine and the engine valve.

The invention as described above makes it possible to avoid the contact between the piston and the engine valve.

In the above-structured invention, the maximum valve lift amount variable mechanism is provided on the rocker shaft, and includes a valve lift mechanism that operates the engine valve with a torque of a cam shaft of the engine, and an actuator linked with the control shaft so as to be driven. The valve lift mechanism is provided on the rocker shaft swingably in a circumferential direction, and includes a slider gear moveable in the axial direction linked with the control shaft, an input arm provided on the slider gear so as to be driven by the cam shaft, and an output arm provided on the slider gear to lift the engine valve. The slider gear has a helical spline at an input side in mesh with the input arm and a helical spline at an output side in mesh with the output arm, which has a tooth trace in an inclined direction opposite to that of a tooth trace of the helical spline at the input side. A relative position between the slider gear and the input and output arms in the axial direction is changed by moving the control shaft by the actuator, and the maximum valve lift amount of the engine valve is changed through a relative rotation between the input arm and the output arm caused by the relative position that has been changed.

In the above-structured invention, the variable valve timing mechanism includes a vane rotor provided with a plurality of vanes, which is fixed to a cam shaft of the engine so as to be integrally rotated, and a housing provided with a plurality of bulkheads corresponding to the plurality of vanes, which is fixed to one of a pulley and a sprocket of the engine so as to be integrally rotated, in which the advance pressure chamber and the retardation pressure chamber are defined by the vane and the bulkheads. A supply amount of the work fluid is adjusted to change a ratio of a capacity of the advance pressure chamber to that of the retardation pressure chamber so as to cause a relative rotation between the vane rotor and the housing, through which a valve timing of the engine valve is changed.

A variable valve mechanism according to the invention is provided with a maximum valve lift amount variable mechanism that changes a maximum valve lift amount of an engine valve through a movement of a control shaft, and a variable valve timing mechanism that changes a valve timing of the engine valve through a selection of a supply mode of a work fluid. The maximum valve lift amount variable mechanism is associated with the variable valve timing mechanism such that an operation of one of the maximum valve lift amount variable mechanism and the variable valve timing mechanism is limited based on an operation of the other so as to avoid a contact between a piston of the engine and an engine valve.

The invention as described above makes it possible to avoid the contact between the piston and the engine valve.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

First Embodiment

A first embodiment of the invention will be described referring to FIGS. 1 to 19. In the embodiment, a variable valve mechanism according to the invention is provided in an in-line 4-cylinder engine.

System Structure

Figure 1:
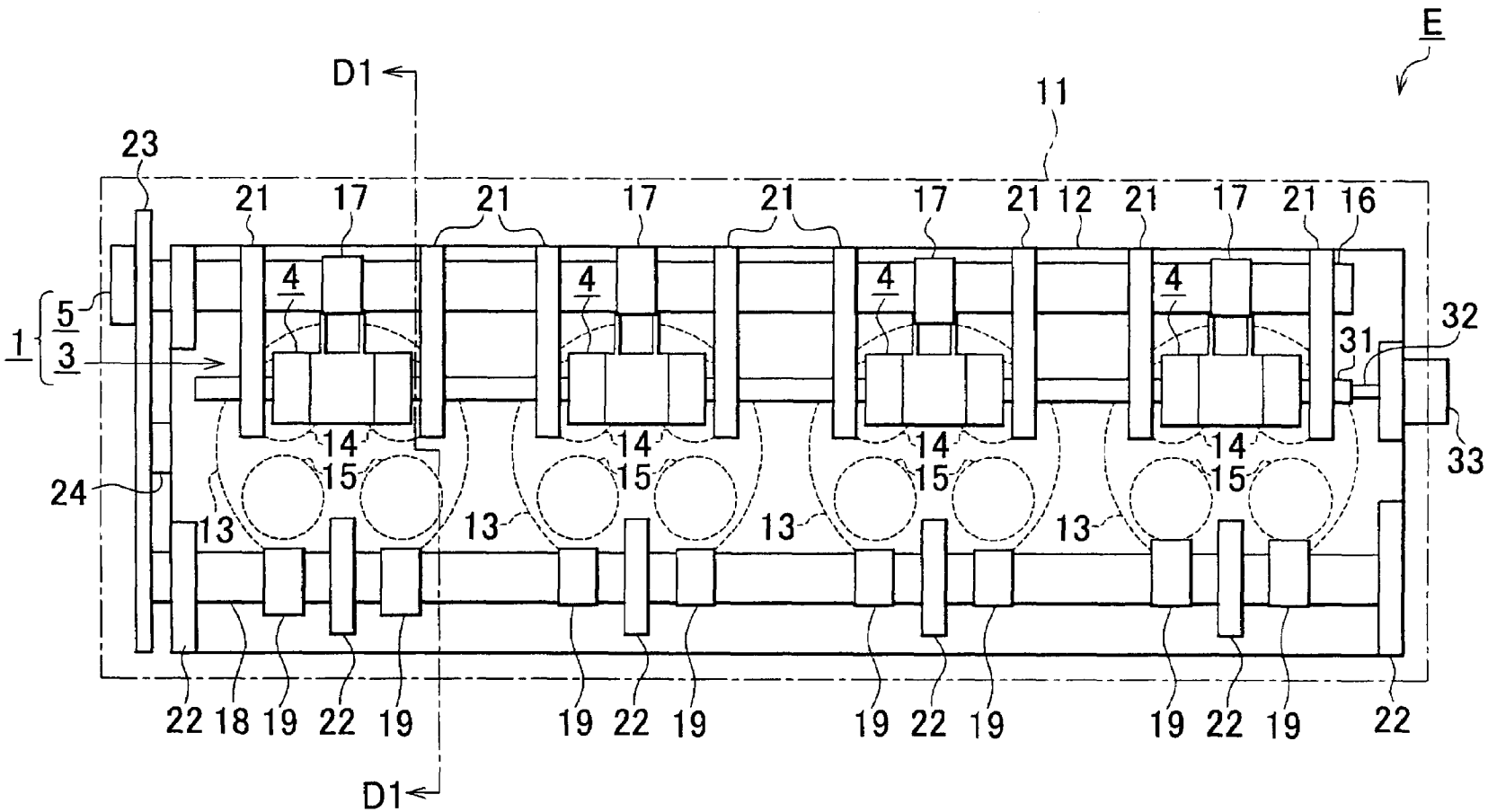
FIG. 1 is a plan view that shows a cylinder head of an engine of a first embodiment as a variable valve mechanism in an engine according to the invention.

Referring to FIG. 1 as a plan view of an engine viewed from a cylinder head, an engine E is formed of a cylinder block 11 and a cylinder head 12.

A plurality of cylinders 13 are provided in the cylinder block 11.

A cylinder head 12 is provided with a pair of intake valves 14 in each of the cylinders 13 so as to open and close an intake port thereof.

The cylinder head 12 is provided with a pair of exhaust valves 15 in each of the cylinders 13 so as to open and close an exhaust port thereof.

Each of the cylinders 13 is provided with an intake cam shaft 16 near the intake valve 14. The intake cam shaft 16 is provided with an intake cam 17 at a position corresponding to each of the cylinders 13.

Each of the cylinders 13 is provided with an exhaust cam shaft 18 near the exhaust valve 15. The exhaust cam shaft 18 is provided with an exhaust cam 19 at a position corresponding to each of the cylinders 13.

The intake cam shaft 16 is rotatively supported through a plurality of bulkheads 21 each defined by a cam carrier formed on the cylinder head 12 and a cam cap attached to the cam carrier.

The exhaust cam shaft 18 is rotatively supported through a plurality of bulkheads 22 each defined by a cam carrier formed on the cylinder head 12 and a cam cap attached to the cam carrier.

The intake cam shaft 16 and the exhaust cam shaft 18 are driven by a crankshaft 24 linked therewith via a timing chain 23. The engine E is provided with a variable valve mechanism 1 that is capable of changing valve characteristics of the intake valve 14 (maximum valve lift amount, operation angle and valve timing).

The variable valve mechanism 1 is formed of a maximum valve lift amount variable mechanism 3 positioned near the intake cam shaft 16 and a variable valve timing mechanism 5 positioned near an end of the intake cam shaft 16.

The maximum valve lift amount variable mechanism 3 sequentially changes both the maximum valve lift amount and the operation angle of each of the intake valves 14. The variable valve timing mechanism 5 advances or retards the valve timing (operation timing) of the intake valve 14 by adjusting a rotary phase of the intake cam shaft 16 relative to the rotary phase of the crankshaft 24. The valve timing is changed using lubricant of the engine E.

The maximum valve lift amount variable mechanism 3 is provided with a plurality of valve lift mechanisms 4 each functioning to lift the intake valve 14 through a torque of the intake cam shaft 16. The valve lift mechanism 4 is positioned between a pair of the adjacent bulkheads 21. In the engine E, each of the valve lift mechanisms 4 is provided for each of the cylinders 13, respectively.

Structure of Maximum Valve Lift Amount Variable Mechanism

Figure 2:
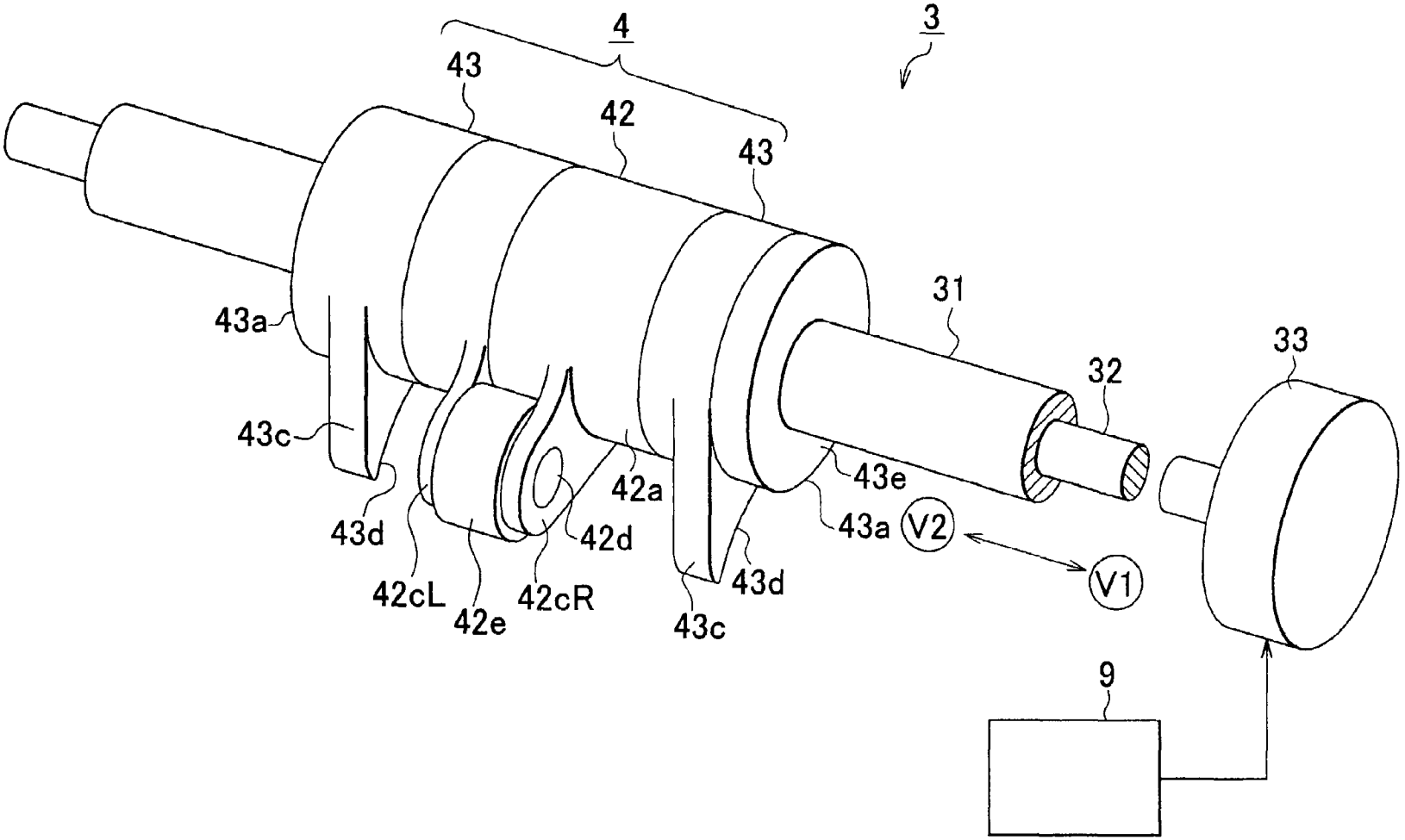
FIG. 2 is a perspective view that shows a structure of a valve lift mechanism of the variable valve mechanism in the engine of the first embodiment.
Figure 3:
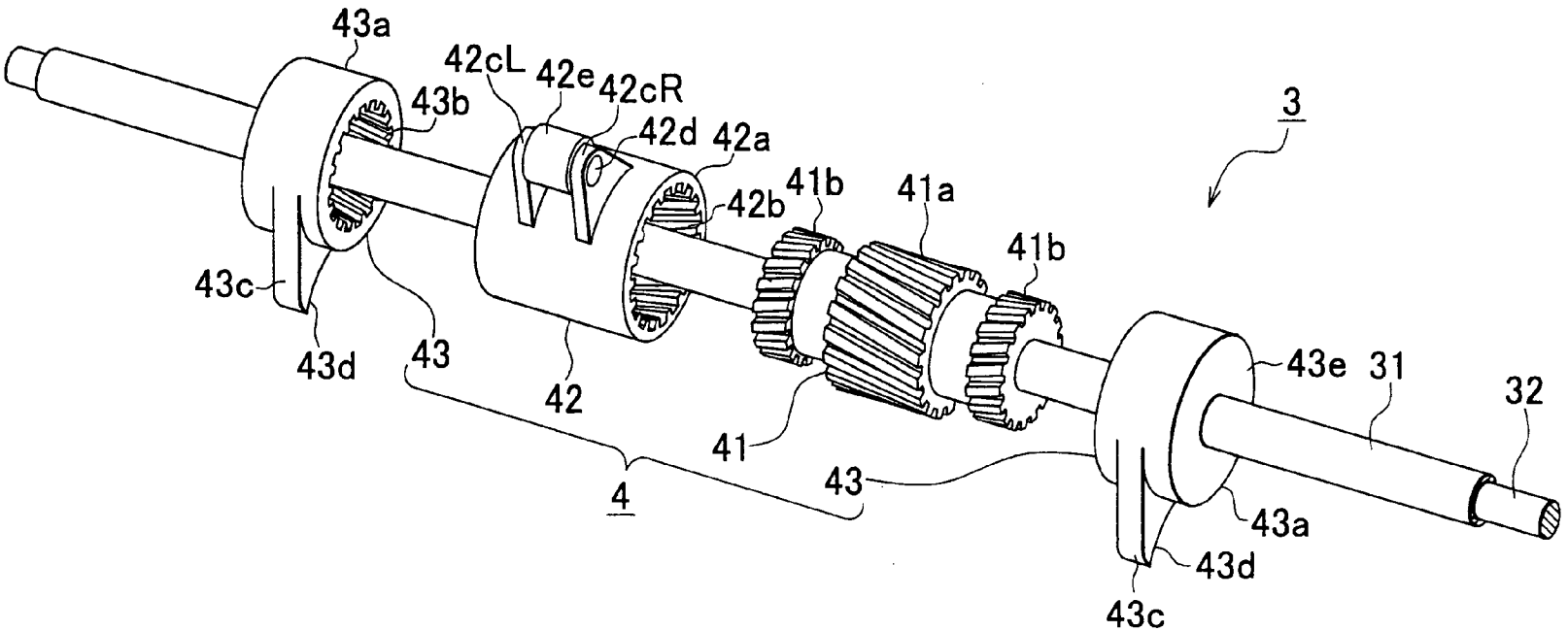
FIG. 3 is an exploded perspective view of the valve lift mechanism of the variable valve mechanism of the engine of the first embodiment.

FIG. 2 is a perspective view of the maximum valve lift amount variable mechanism 3. FIG. 3 is an exploded perspective view of the maximum valve lift amount variable mechanism 3.

The maximum valve lift amount variable mechanism 3 is provided with a rocker shaft 31, a control shaft 32, a shaft actuator 33, and the valve lift mechanism 4. In the cylinder head 12, the rocker shaft 31 is set so as to extend toward the direction of the arrangement of the cylinders (direction of arrow V), that is, it is set in parallel with the intake cam shaft 16.

The rocker shaft 31 is fixed through the bulkhead 21 so as not to rotate nor move in the axial direction. The arrow V1 represents the direction toward the shaft actuator 33, and the arrow V2 represents the direction away from the shaft actuator 33

The control shaft 32 is set in the rocker shaft 31 so as to be movable in the axial direction. The control shaft 32 is linked with the shaft actuator 33 so as to be driven.

The shaft actuator 33 is driven by an electronic control unit 9 that executes various control routines with respect to operations of the engine E. The electronic control unit 9 is formed of a CPU that executes various processings with respect to the control of the engine E, a memory that stores control programs and information necessary for the control, and input/output ports through which signals are input from and output to the outside.

The ECU 9 controls the shaft actuator 33 to displace the control shaft 32 in the axial direction such that the maximum valve lift amount of the intake valve 14 is changed.

The valve lift mechanism 4 is provided at a position corresponding to each of the cylinders 13 on the single rocker shaft 31 that supports all the valve lift mechanisms 4.

Each of the valve lift mechanisms 4 is formed of a slider gear 41, an input arm 42 and an output arm 43. The slider gear 41 is provided on the rocker shaft 31, and linked with the control shaft 32 so as to be movable on the rocker shaft 31 in the axial direction.

The slider gear 41, the input arm 42 and the output arm 43 are meshed with each other through a helical spline. The input arm 42 and the output arm 43 are assembled with the slider gear 41 such that each end surface between those arms 42 and 43 is in contact with each other.

Structure of Slider Gear

A helical spline (helical spline 41*a* at the input side) in mesh with a helical spline 42*b* around the input arm 42 is formed in the center of the axis of the slider gear 41. Helical splines (helical spline 41*b* at the output side) in mesh with a helical spline 43*b* formed around the output arm 43 are provided at both ends in the axial direction. The inclined direction of the trace of the helical spline 41*a* at the input side is opposite to that of the trace of the helical spline 41*b* at the output side.

Structure of Input Arm

A body of the input arm 42 (housing 42*a*) has an inner space that extends in the axial direction of the rocker shaft 31.

A helical spline 42*b* in mesh with the helical spline 41*a* at the input side of the slider gear 41 is formed on the inner peripheral surface of the hosing 42*a*. A pair of arms 42*c*L and 42*c*R that extend outwardly in the radial direction are formed on the outer peripheral surface of the housing 42*a*. The arms 42*c*L and 42*c*R are formed so as to be in parallel with each other.

A shaft 42*d* is provided between the arms 42*c*L and 42*c*R so as to be in parallel with the axis of the rocker shaft 31. The shaft 42*d* is provided with a roller 42*e* that is allowed to rotate.

Structure of Output Arm

A body of the output arm 43 (housing 43*a*) has an inner space that extends in the axial direction of the rocker shaft 31.

A helical spline 43*b* in mesh with the helical spline 41*b* at the output side of the slider gear 41 is formed on the inner peripheral surface of the hosing 43*a*. The inclined direction of the trace of the helical spline 43*b* of the output arm 43 is opposite to that of the trace of the helical spline 42*b* of the input arm 42.

A nose 43*c* that protrudes outwardly in the radial direction is formed on the outer peripheral surface of the housing 43*a*. The nose 43*c* is formed in a substantially triangular shape with one side provided with a cam surface 43*d* that is concavely curved.

A bearing 43*e* for supporting the rocker shaft 31 is formed on the end surface of the housing 43*a*, which is perpendicular to the center axis of the rocker shaft 31 and is not in contact with the input arm 42.

Assembly Structure of Variable Valve Mechanism

Figure 4:
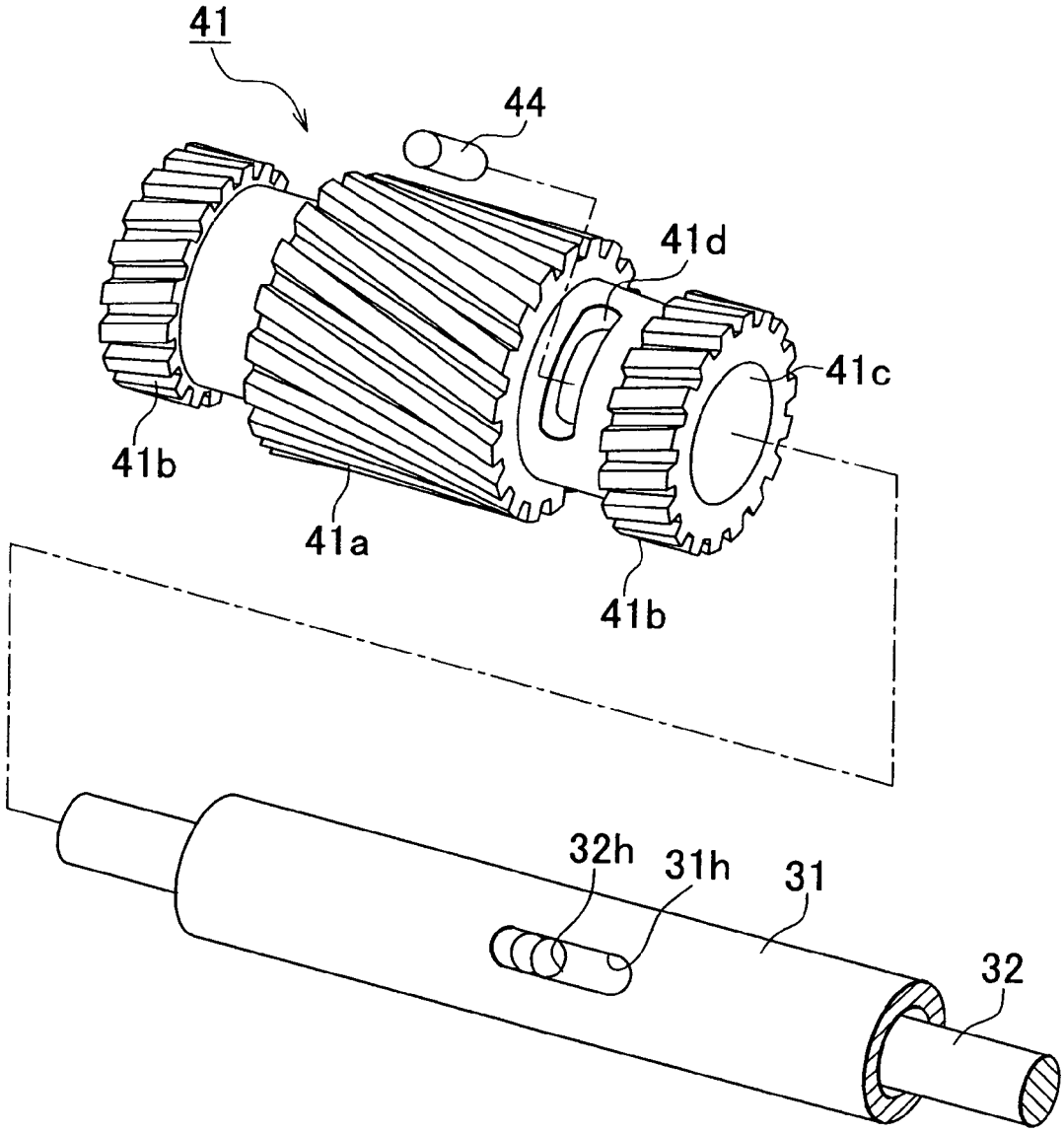
FIG. 4 is an exploded perspective view of the valve lift mechanism of the variable valve mechanism in the engine of the first embodiment.

FIG. 4 is a perspective view that shows the slider gear 41, the rocker shaft 31 and the control shaft 32.

A through-hole 41*c* that extends in the axial direction is formed in the axial center of the slider gear 41. A slot 41*d* that extends in the circumferential direction is formed between the helical splines 41*a* and 41*b*.

A slot 31*h* that extends in the axial direction is formed in the rocker shaft 31 at a position corresponding to the slot 41*d* formed in the slider gear 41. An insert hole 32*h* is formed in the control shaft 32 at a position corresponding to the slot 31*h* formed in the rocker shaft 31.

A lock pin 44 is inserted through a portion at which the slot 41*d* of the slider gear 41 and the slot 31*h* of the rocker shaft 31 cross with each other in the state where the rocker shaft 31 and the control shaft 32 are inserted into the through-hole 41*c* of the slider gear 41. One end of the lock pin 44 is fixed to the insert hole 32*h* of the control shaft 32.

In the thus assembled maximum valve lift amount variable mechanism 3, the slider gear 41 is moved as follows.

As the lock pin 44 is allowed to move along the slot 31*h* of the rocker shaft 31, the slider gear 41 moves in the axial direction linked with the axial movement of the control shaft 32.

As the lock pin 44 is inserted into the slot 41*d* of the slider gear 41, the slider gear 41 rocks around the rocker shaft 31 upon transfer of the torque of the intake cam shaft 16 to the input arm 42.

As aforementioned, the slider gear 41 has its axial position fixed on the control shaft 32, but is allowed to move in the axial direction on the rocker shaft 31. Further the slider gear 41 is allowed to pivotally rotate while being supported at the rocker shaft 31 (control shaft 32).

Inner Structure of the Valve Lift Mechanism

Figure 5:
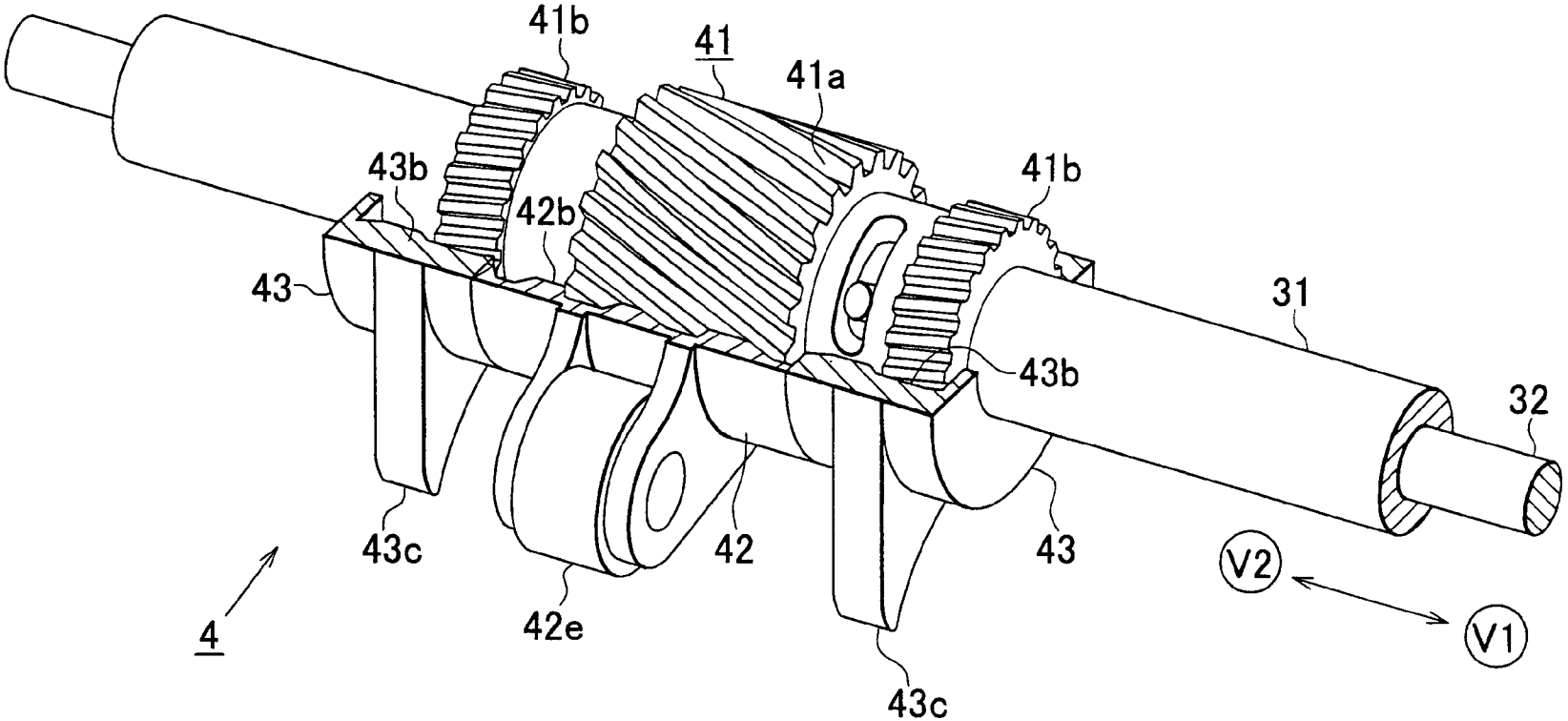
FIG. 5 is a perspective view of the valve lift mechanism in the state where the upper half portion of an input and output arms are removed.

FIG. 5 is a perspective view of the valve lift mechanism 4 having each upper half portion of the input and output arms 42 and 43 removed.

In the valve lift mechanism 4, the helical spline 41*a* at the input side of the slider gear 41 is meshed with the helical spline 42*b* of the input arm 42. The helical spline 41*b* at the output side of the slider gear 41 is meshed with the helical spline 43*b* of the output arm 43.

When the slider gear 41 is moved in the axial direction together with the control shaft 32 so as to change the relative position among the slider gear 41 and the input/output arms 42, 43 in the axial direction, and accordingly torsional forces in opposite directions are applied to the input arm 42 and the output arm 43, respectively. The input arm 42 and the output arm 43 relatively rotate such that the relative phase difference between the input arm 42 (roller 42*e*) and the output arm 43 (nose 43*c*) is changed. In the maximum valve lift amount variable mechanism 3, all the slider gears 41 are fixed to the control shaft 32. Accordingly, as the control shaft 32 moves, the respective maximum valve lift amounts of all the cylinders 13 are changed simultaneously.

The engine E is structured to change the maximum valve lift amount by changing the aforementioned relative phase difference.

When the relative phase difference is the smallest, that is, the roller 42*e* is in the closest position to the nose 43*c* in the circumferential direction of the valve lift mechanism 4, the maximum valve lift amount of the intake valve 14 takes the smallest value. The resultant maximum valve lift amount will be set as the minimum lift amount Lmin hereinafter.

When the aforementioned phase difference is the largest, that is, the roller 42*e* is in the farthest position from the nose 43*c* in the circumferential direction of the valve lift mechanism 4, the maximum valve lift amount of the intake valve 14 takes the largest value. The resultant maximum valve lift amount will be set as the maximum lift amount Lmax hereinafter.

Valve Lift Structure in Engine

Figure 6:
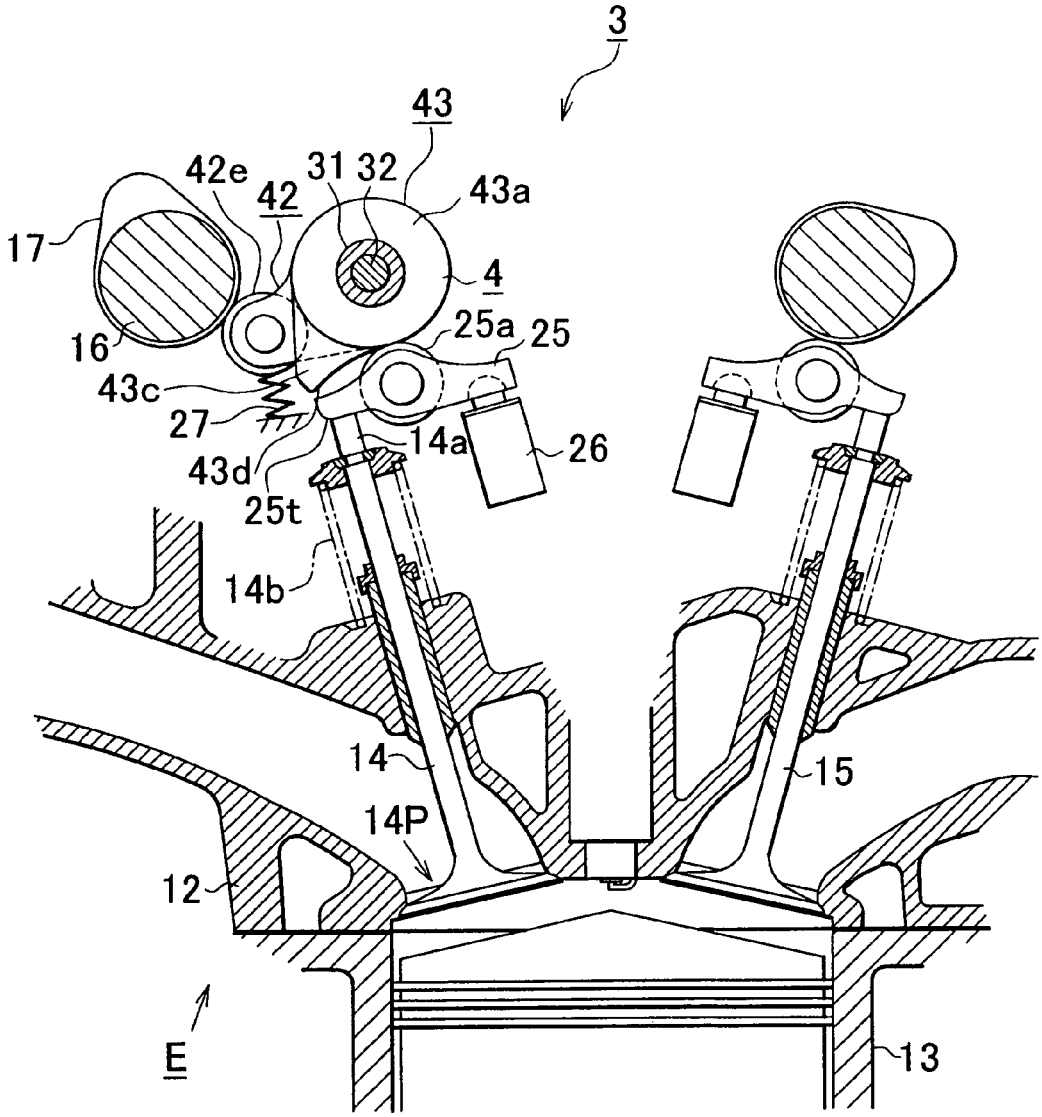
FIG. 6 is a cross sectional view of the engine of the first embodiment taken along line D1-D1 of FIG. 1.

FIG. 6 is a cross sectional view of the engine E taken along line D1-D1 shown in FIG. 1. The maximum valve lift amount variable mechanism 3 is provided between the intake cam 17 of the intake cam shaft 16 and a roller rocker arm 25 in the cylinder head 12.

The roller rocker arm 25 is provided between the maximum valve lift amount variable mechanism 3 and the intake valve 14. One end of the roller rocker arm 25 is supported with a lash adjuster 26 fixed to the cylinder head 12. The other end of the roller rocker arm 25 abuts on a tappet 14*a* on the upper end of the intake valve 14.

An end of the roller rocker arm 25 (tappet side end portion 25*t*) at the side of the tappet 14*a* is biased against the maximum valve lift amount variable mechanism 3 by a valve spring 14*b* of the intake valve 14. This allows the roller 25*a* of the roller rocker arm 25 to be constantly brought into abutment on the valve lift mechanism 4.

The roller 42*e* of the input arm 42 is biased to be constantly pressed against the intake cam 17 by a spring 27 under pressure provided in the cylinder head 12. In the output arm 43, one of a base circular portion of the housing 43*a* and the cam surface 43*d* of the nose 43*c* is constantly in abutment on the roller 25*a* of the roller rocker arm 25.

In the above-structured engine E, as the valve lift mechanism 4 is swung by the rotation of the intake cam shaft 16, the roller rocker arm 25 is pressed by the output arm 43. Then the swing operation of the roller rocker arm 25 serves to lift the intake valve 14.

Valve Lift Operation Performed by Variable Valve Mechanism

Referring to FIG. 7, an operation state of the maximum valve lift amount variable mechanism 3 in the case where the control shaft 32 is moved in the direction to approach the shaft actuator 33 as close as possible (direction of arrow V1 shown in FIG. 2) will be described.

Figure 7B:
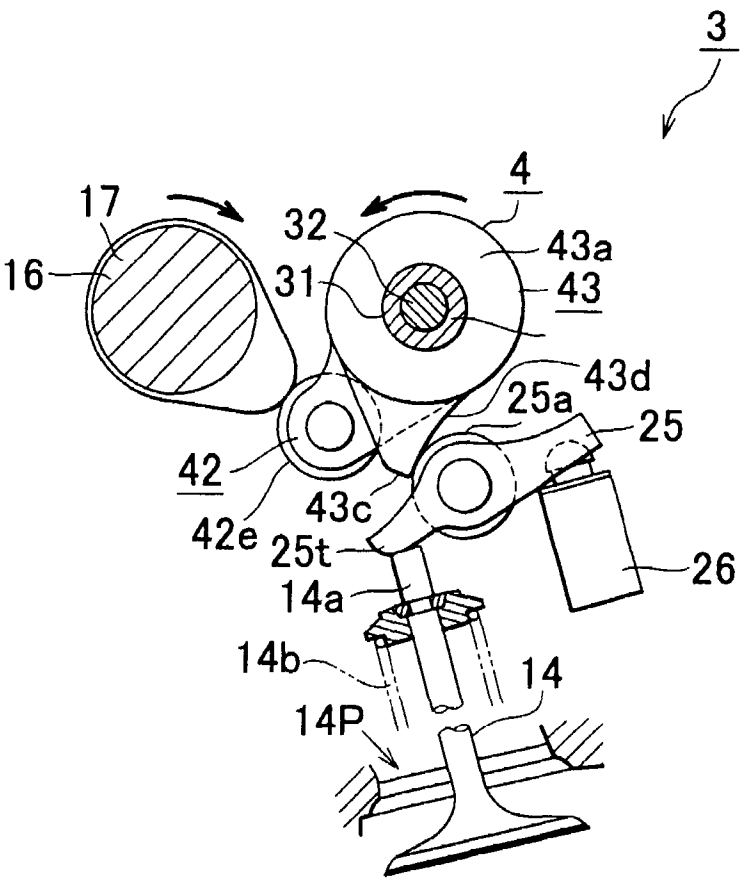
FIGS. 7*a* and 7*b* are views that show an example of the operation of the variable valve mechanism in the engine according to the first embodiment.
Figure 7A:
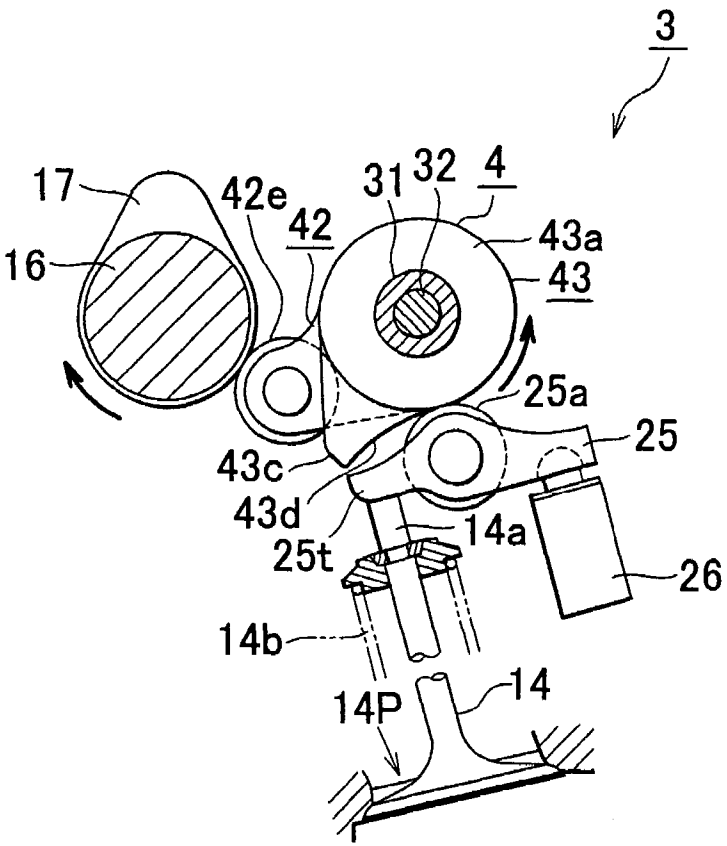

Referring to FIG. 7A, when the base circular portion of the intake cam 17 abuts on the roller 42*e* of the input arm 42, the roller 25*a* of the roller rocker arm 25 also abuts on the base circular portion of the housing 43*a*. Accordingly the intake valve 14 is maintained in the state where the lift amount is zero (intake port 14P of the engine E is closed).

When the roller 42*e* of the input arm 42 is depressed through a lift portion of the intake cam 17 accompanied with the rotation of the intake cam shaft 16, the input arm 42 is rotated counterclockwise relative to the rocker shaft 31 (arrowed direction shown in FIG. 7A). The slider gear 41 and the output arm 43 are rotated together.

The cam surface 43*d* formed on the nose 43*c* of the output arm 43 is brought into abutment on the roller 25*a* of the roller rocker arm 25, and the roller 25*a* is depressed under the depression force applied by the cam surface 43*d*.

Referring to FIG. 7B, when the roller 25*a* of the roller rocker arm 25 is depressed through the cam surface 43*d*, the roller rocker arm 25 rocks at an abutment portion on the lash adjuster 26. Accordingly the intake valve 14 is opened.

In the state where the control shaft 32 is moved to approach the shaft actuator 33 as close as possible, the relative phase difference between the roller 42*e* of the input arm 42 and the nose 43*c* of the output arm 43 becomes maximum around the axial center of the rocker shaft 31. This may allow the displacement amount of the roller 25*a* of the roller rocker arm 25 to be maximized upon depression of the roller 42*e* to maximum by the intake cam 17. Therefore the intake valve 14 may be opened and closed at the maximum valve operation angle and the maximum valve lift amount.

Referring to FIG. 8, an operation state of the maximum valve lift amount variable mechanism 3 in the case where the control shaft 32 is moved in the direction away from the shaft actuator 33 as far as possible (direction of arrow V2 shown in FIG. 2) will be described.

Figure 8B:
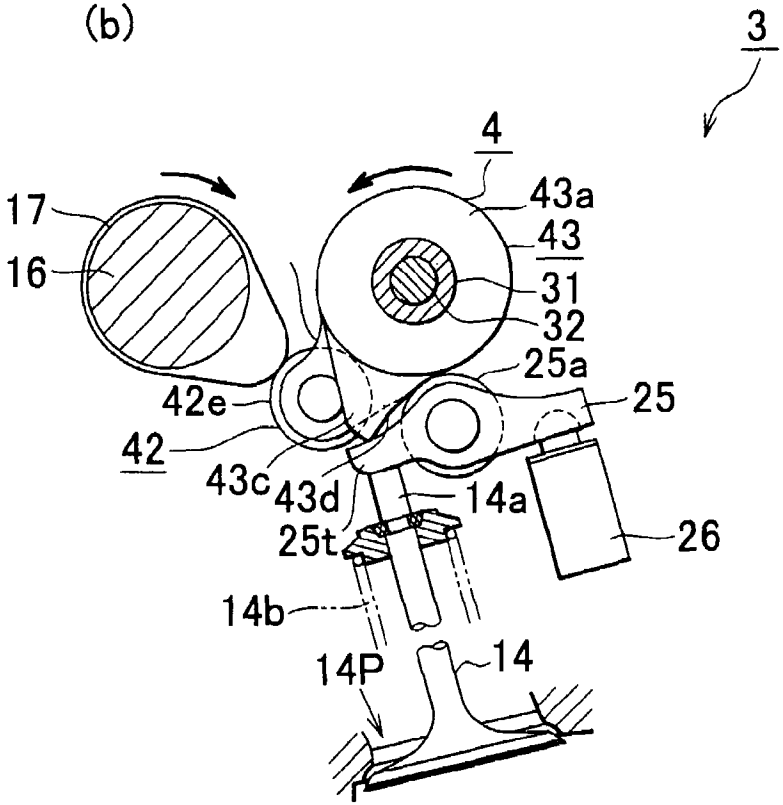
FIGS. 8*a* and 8*b* are views that show another example of the operation of the variable valve mechanism in the engine according to the first embodiment.
Figure 8A:
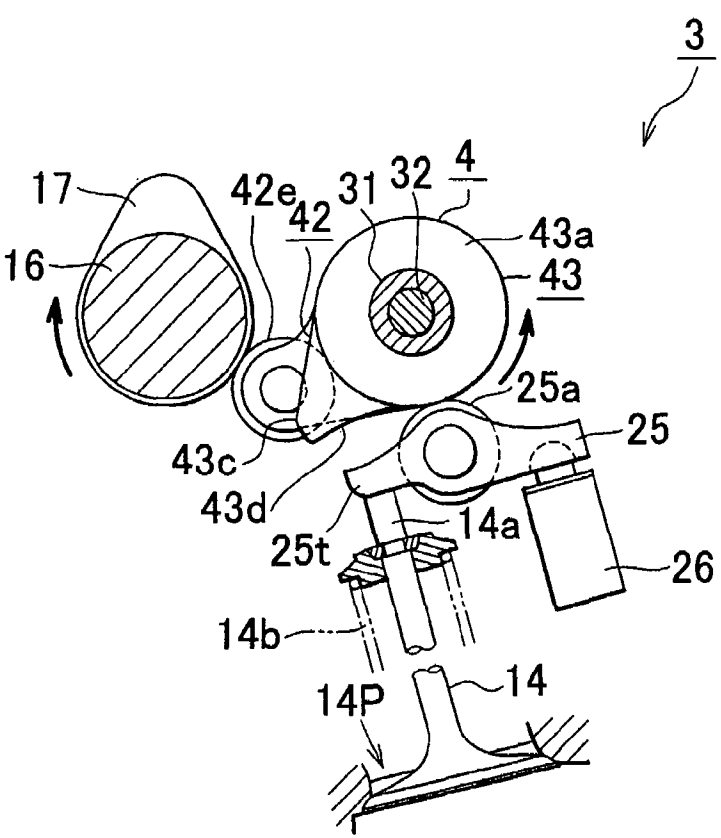

Referring to FIG. 8A, when the base circular portion of the intake cam 17 abuts on the roller 42*e* of the input arm 42, the position at which the roller 25*a* abuts on the output arm 43 is apart from the cam surface 43*d* as far as possible. When the roller 42*e* of the input arm 42 is depressed through the lift portion of the intake cam 17 by the rotation of the intake cam shaft 16, the output arm 43 is rotated together with the input arm 42.

In this case, as the position at which the roller 25*a* abuts on the output arm 43 is apart from the cam surface 43*d* to maximum, the rotation amount of the output arm 43 becomes larger than that of the operation state as shown in FIG. 7 until the roller 25*a* of the roller rocker arm 25 is depressed by the cam surface 43*d*. When the roller 42*e* of the input arm 42 is depressed through the lift portion of the intake arm 42, the range of the cam surface 43*d* on which the roller 25*a* abuts is reduced to a portion of the nose 43*c* at the base end side. Accordingly the amount of swing of the roller rocker arm 25 in accordance with the depression applied to the roller 42*e* by the lift portion of the intake cam 17 becomes small.

As shown in FIG. 8B, as the swing amount of the roller rocker arm 25 is small, the intake valve 14 may be opened by smaller valve lift amount. In the state where the control shaft 32 is moved to the direction away from the shaft actuator 33 to maximum, the relative phase difference between the roller 42*e* and the nose 43*c* around the rocker shaft 31 is minimized. As the displacement of the roller 25*a* upon depression of the roller 42*e* by the intake cam 17 to maximum is minimized, the intake valve 14 may be operated at the smallest valve angle by the smallest valve lift amount.

In the engine E, there is a predetermined relationship between the maximum valve lift amount and the operation angle of the intake valve 14. That is, when the maximum valve lift amount of the intake valve 14 is changed, the operation angle of the intake valve 14 is changed by an amount corresponding to the changed maximum valve lift amount.

Structure of Variable Valve Timing Mechanism

Figure 9:
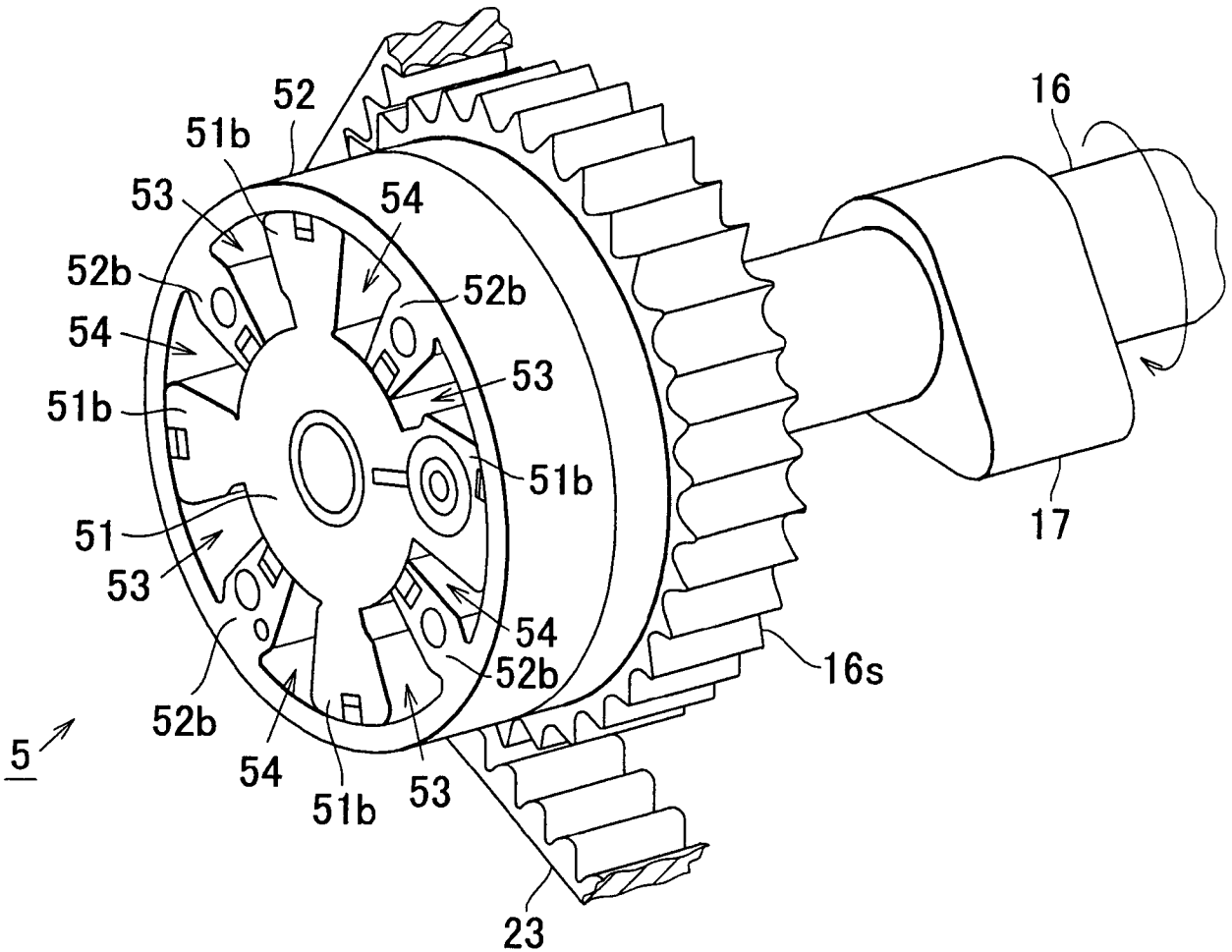
FIG. 9 is a perspective view of the valve timing variable mechanism of the first embodiment in the state where a part of the housing is removed.

FIG. 9 is a perspective view that shows an inner structure of a variable valve timing mechanism 5. An arrow (clockwise) direction shown in FIG. 9 is set as a rotating direction of the intake cam shaft 16.

In the engine E, a cam sprocket 16*s* is formed on the intake cam shaft 16 so as to rotate relative thereto. The cam sprocket 16*s* is linked with the crankshaft 24 through the timing chain 23 so as to be driven.

The variable valve timing mechanism 5 is formed of a vane rotor 51 and a housing 52. The vane rotor 51 is provided within the housing 52 so as to rotate relative thereto, and fixed to the intake cam shaft 16 so as to be rotated together therewith.

A plurality of vanes 51*b* are formed on the outer periphery of the vane rotor 51. The housing 52 is fixed to the cam sprocket 16*s* so as to rotate together therewith. A plurality of pressure bulkheads 52*b* are formed on the inner periphery of the vane rotor 51.

In the valve timing variable mechanism 5, an advance pressure chamber 53 and a retardation pressure chamber 54 are formed in the space defined by the vane 51*b* and the pressure bulkhead 52*b* opposed thereto. The advance pressure chamber 53 and the retardation pressure chamber 54 are formed adjacent with each other having the vane 51*b* interposed therebetween. The advance pressure chamber 53 is formed at the position opposite to the rotating direction of the intake cam shaft 16 in reference to the vane 51*b*. The retardation pressure chamber 54 is formed at the side of the rotating direction of the intake cam shaft 16 in reference to the vane 51*b*.

Lubricant Supply Structure in Variable Valve Timing Mechanism

Figure 10:
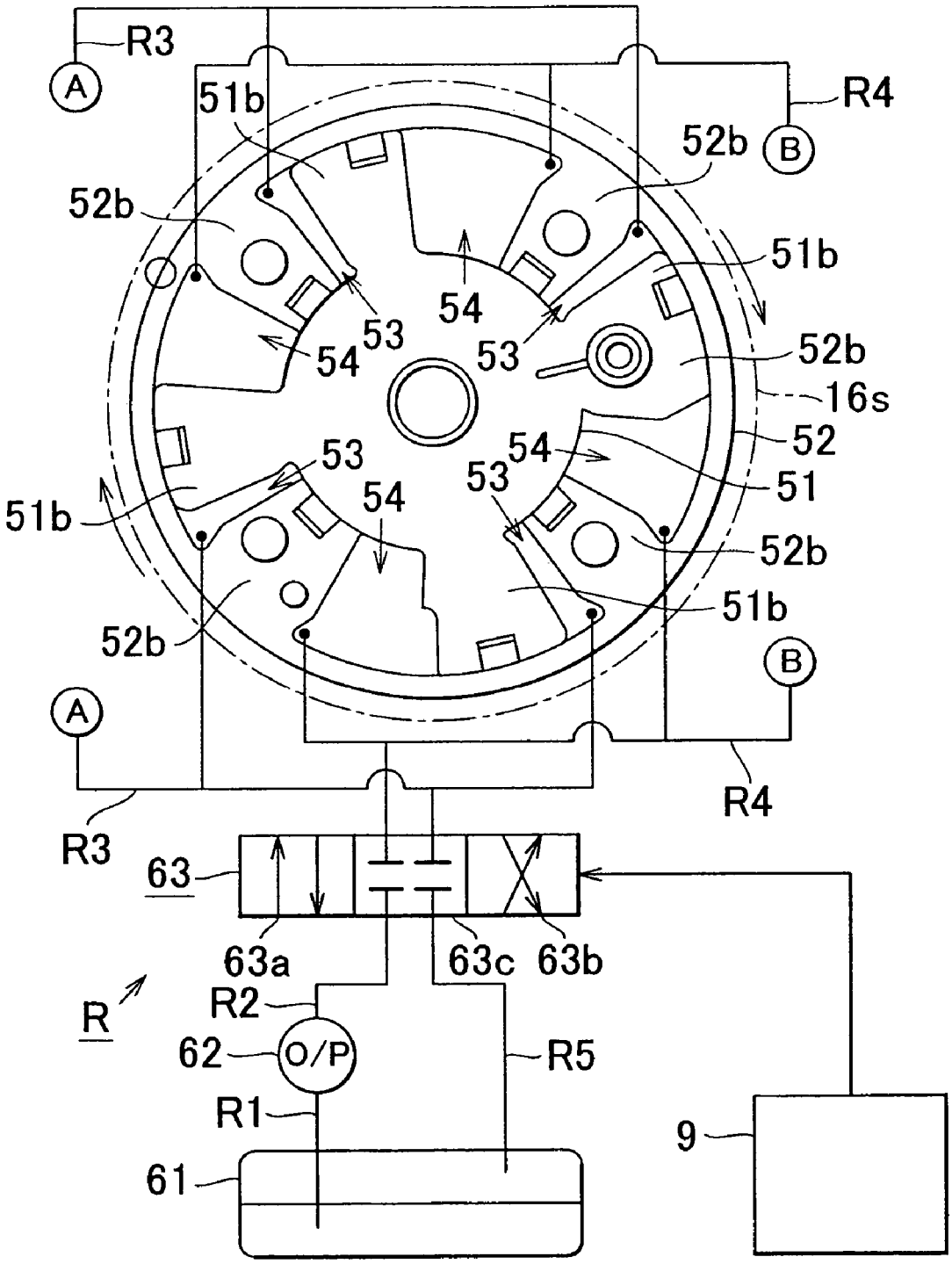
FIG. 10 shows a structure for supplying the lubricant of the valve timing variable mechanism of the first embodiment.

FIG. 10 is a view that shows a lubricant supply structure in the variable valve timing mechanism 5. The rotating direction of the intake cam shaft 16 is shown as the arrowed (clockwise) direction.

The variable valve timing mechanism 5 is provided with a lubricant supply pipe R (first supply pipe R1 to fifth supply pipe R5) through which the advance pressure chamber 53 and the retardation pressure chamber 54 are connected to an oil pan 61 serving as a work fluid supply source in the engine E.

The lubricant supply pipe R is provided with an oil pump 62 for press feeding the lubricant of the oil pan 61 and an oil control valve 63 for changing the lubricant supply path. The electronic control unit 9 adjusts the amount of the lubricant to be supplied to the advance pressure chamber 53 and the retardation pressure chamber 54, respectively by controlling the oil control valve 63. The ratio of the capacity of the advance pressure chamber 53 to the retardation pressure chamber 54 is changed so as to change the valve timing of the intake valve 14.

The connection of the oil pan 61 to the advance pressure chamber 53 and the retardation pressure chamber 54 will be described hereinafter. The oil pan 61 is connected to the oil pump 62 via the first supply pipe R1, and the oil pump 62 is connected to the oil control valve 63 via the second supply pipe R2.

The oil control valve 63 is connected to the advance pressure chamber 53 via the third supply pipe R3 (advance oil passage). The oil control valve 63 is connected to the retardation pressure chamber 54 via the fourth supply pipe R4.

The oil control valve 63 is connected to the oil pan 61 via the fifth supply pipe R5. The oil control valve 63 is provided with ports [a] to [c] as follows:

[a] a retardation port 63*a* that feeds the lubricant into the retardation pressure chamber 54 while feeding the lubricant from the advance pressure chamber 53,

[b] an advance port 63*b* that feeds the lubricant into the advance pressure chamber 53 while feeding the lubricant from the retardation pressure chamber 54; and

[c] a closing port 63*c* that retains the lubricant both in the advance pressure chamber 53 and the retardation pressure chamber 54.

In the variable valve timing mechanism 5, the lubricant supply path is determined depending on the port of the oil control valve 63. When the retardation port 63*a* is selected, the second and the fourth supply pipes R2 and R4 are connected, and the third and the fifth supply pipes R3 and R5 are connected. That is, the lubricant is supplied to the retardation pressure chamber 54 from the oil pump 62, and the lubricant in the advance pressure chamber 53 is discharged into the oil pan 61 such that the valve timing is retarded (the advance angle is reduced.).

When the advance port 63*b* is selected, the second and the third supply pipes R2 and R3 are connected, and the fourth and the fifth supply pipes R4 and R5 are connected. That is, the lubricant from the oil pump 62 is supplied to the advance pressure chamber 53, and the lubricant in the retardation pressure chamber 54 is discharged into the oil pan 61 such that the valve timing is advanced (advance angle is increased.).

When the closing port 63*c* is selected, the connection between the second and the fifth supply pipes R2 and R5, and the connection between the third and the fourth supply pipes R3 and R4 are released. That is, the lubricant is retained in both the advance and the retardation pressure chambers 53 and 54. When the change in the valve timing is not required, the oil control valve 63 is maintained in the state where the closing port 63*c* is selected.

Change in Valve Timing

The valve timing of the intake valve 14 is changed in the range between the most advanced state (angle) and the most retarded state (angle) by changing the advance angle performed by the variable valve timing mechanism 5. When the valve timing is at the most advanced angle, the advance angle becomes maximum (Tmax). When the valve timing is at the most retarded angle, the advance angle becomes minimum (Tmin).

[1] Advance

The advance of the valve timing performed by the variable valve timing mechanism 5 will be described. The electronic control unit 9 selects the port of the oil control valve 63 to the advance port 63*b*. This may allow the lubricant that has been press fed through the oil pump to be supplied into the advance pressure chamber 53, and the lubricant in the retardation pressure chamber 54 to be discharged to the oil pan 61.

The difference in the pressure between the advance pressure chamber 53 and the retardation pressure chamber 54 causes the vane rotor 51 to rotate toward the advance direction (rotating direction of the intake cam shaft 16) relative to the housing 52. The rotary phase of the intake cam shaft 16 (intake cam 17) relative to the rotary phase of the crankshaft 24 is changed through the relative rotation of the vane rotor 51 to the advance side such that the valve timing of the intake vale 14 is advanced. After completion of the change in the valve timing, the port of the oil control valve 63 is selected from the advance port 63*b* to the closing port 63*c*.

[2] Retardation

The retardation of the valve timing by the variable valve timing mechanism 5 will be described. The electronic control unit 9 changes the port of the oil control valve 63 from the closing port 63*c* to the retardation port 63*a* upon a request for retarding the valve timing of the intake valve 14. The lubricant that has been press fed through the oil pump 62 is supplied to the retardation pressure chamber 54, and the lubricant in the advance pressure chamber 53 is discharged into the oil pan 61.

The difference in the pressure between the retardation pressure chamber 54 and the advance pressure chamber 53 causes the vane rotor 51 to rotate toward the direction of retardation (opposite to the rotating direction of the intake cam shaft 16) relative to the housing 52. The rotary phase of the intake cam shaft 16 (intake cam 17) relative to the rotary phase of the crankshaft 24 is changed through the relative rotation of the vane rotor 51 such that the valve timing of the intake vale 14 is retarded. After completion of the change in the valve timing, the port of the oil control valve 63 is selected from the retardation port 63*a* to the closing port 63*c*.

Problem Caused by the Change in Valve Characteristic

In the engine that allows the maximum valve lift amount and the valve timing to be changed, it may be the case that the contact between the piston and the intake valve occurs resulting from the change in the maximum valve lift amount or the valve timing. The relationship between the valve characteristics (operative range of the variable valve mechanism) and the contact between the piston and the intake valve will be described hereinafter.

Figure 11:
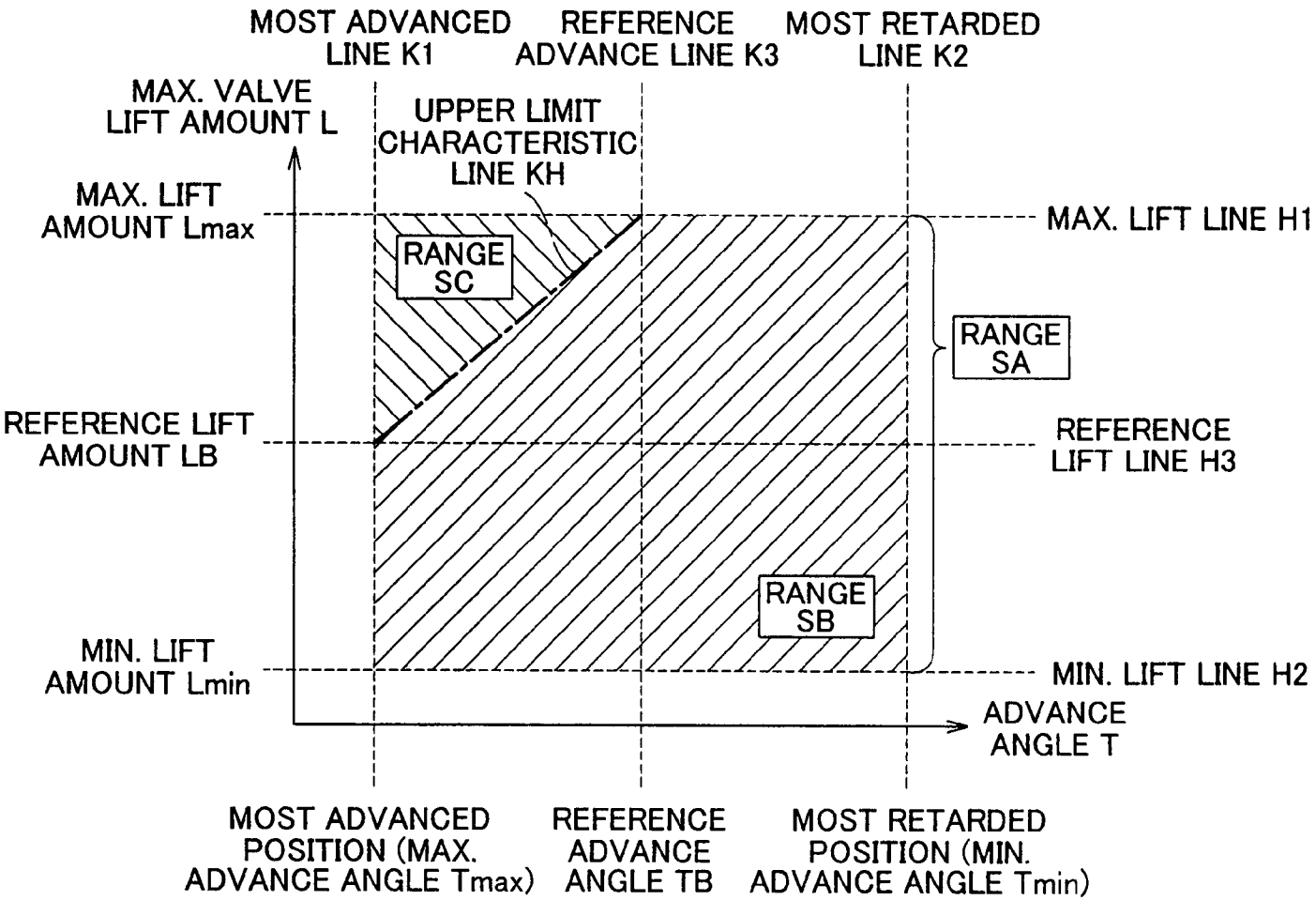
FIG. 11 is a view that shows a relationship between the advance angle and the maximum valve lift amount.

FIG. 11 shows a diagram representing the relationship between the advance angle and the maximum valve lift amount. The aforementioned engine allows the variable valve mechanism to be operated in the area defined by the most advanced angle line K1, the most retarded angle line K2, the maximum lift line H1 and the minimum lift line H2 (whole area SA). That is, the valve characteristics of the intake valve 14 may be changed in the whole area SA.

In the diagram representing the relationship between the advance angle and the maximum valve lift amount, the reference lift amount LB is represented by the reference lift line H3, and the reference advance angle line TB is represented by the reference advance angle line K3. The reference lift amount LB refers to the lift amount that locates on the boundary between the maximum valve lift amount at which the contact between the piston and the intake valve 14 is not caused by the change in the advance angle to an arbitrary value and the maximum valve lift amount at which the contact between the piston and the intake valve 14 is caused by the change in the advance angle to the value equal to or larger than the upper limit advance angle Tlim.

The reference advance angle TB refers to the advance angle that locates on the boundary between the advance angle at which the contact between the piston and the intake valve 14 is not caused by the change in the maximum valve lift amount to an arbitrary value and the advance angle at which the contact between the piston and the intake valve 14 is caused by the change in the maximum valve lift amount to the value equal to or larger than the upper limit lift amount Llim.

In the state where the maximum valve lift amount is fixed to an arbitrary value that is equal to or larger than the reference lift amount LB, when the advance angle is increased toward the maximum advance angle Tmax, the contact between the piston and the intake valve 14 occurs at a time when the advance angle exceeds a predetermined value. The predetermined value corresponds to the upper limit advance angle Tlim.

The upper limit advance angle Tlim changes in accordance with the maximum valve lift amount as follows:

[A] When the maximum valve lift amount is smaller than the reference lift amount LB, the upper limit advance angle Tlim becomes the maximum advance angle Tmax.

[B] When the maximum valve lift amount is equal to or larger than the reference lift amount LB, the upper limit advance angle Tlim is reduced in accordance with the increase in the maximum valve lift amount.

In the state where the advance angle is fixed to an arbitrary value equal to or larger than the reference advance angle TB, when the maximum valve lift amount is increased toward the maximum lift amount Lmax, the contact between the piston and the intake valve 14 occurs at a time when the maximum valve lift amount exceeds a predetermined value. The predetermined value corresponds with the upper limit lift amount Llim.

The upper limit lift amount Llim changes in accordance with the advance angle in the manner as described below.

[A] When the advance angle is smaller than the reference advance angle TB, the upper limit lift amount Llim becomes the maximum advance angle Tmax.

[B] When the advance angle is equal to or larger than the reference advance angle TB, the upper limit lift amount Llim is reduced as the increase in the advance angle.

The relationship between the upper limit advance angle Tlim and the maximum valve lift amount (upper limit lift amount Llim and advance angle) is represented by an upper limit characteristic curve KH in the diagram that shows the relationship between the advance angle and the maximum valve lift amount. The upper limit characteristic curve KH in FIG. 11 is shown as the example. The upper limit characteristic curve differs depending on the structure of the variable valve mechanism.

The area defined by the upper limit characteristic curve KH, the most retarded angle line K2 and the minimum lift line H2, that is, an effective area SB in the whole area SA represents the area of the valve characteristics where the contact between the piston and the intake valve does not occur. In other words, the effective area SB corresponds with the area that allows the variable valve mechanism to be operated.

The area defined by the upper limit characteristic curve KH, the most advanced angle line K1 and the maximum lift line H1, that is, ineffective area SC in the whole area SA represents the area of the valve characteristics where the contact between the piston and the intake valve 14 occurs. In other words, the ineffective area SC corresponds with the area that does not allow the variable valve mechanism to be operated.

Correlation between Maximum Valve Lift Amount Variable Mechanism and Variable Valve Timing Mechanism The variable valve mechanism 1 according to the embodiment is structured to have the maximum valve lift amount variable mechanism 3 linked with the variable valve timing mechanism 5 so as to prevent the variable valve mechanism 1 from being operated in the aforementioned ineffective area SC. That is, the maximum valve lift amount variable mechanism 3 is linked with the variable valve timing mechanism 5 so as to restrain the operation of one of those mechanisms by means of the other mechanism for the purpose of avoiding the contact between the piston and the intake valve 14.

Figure 12:
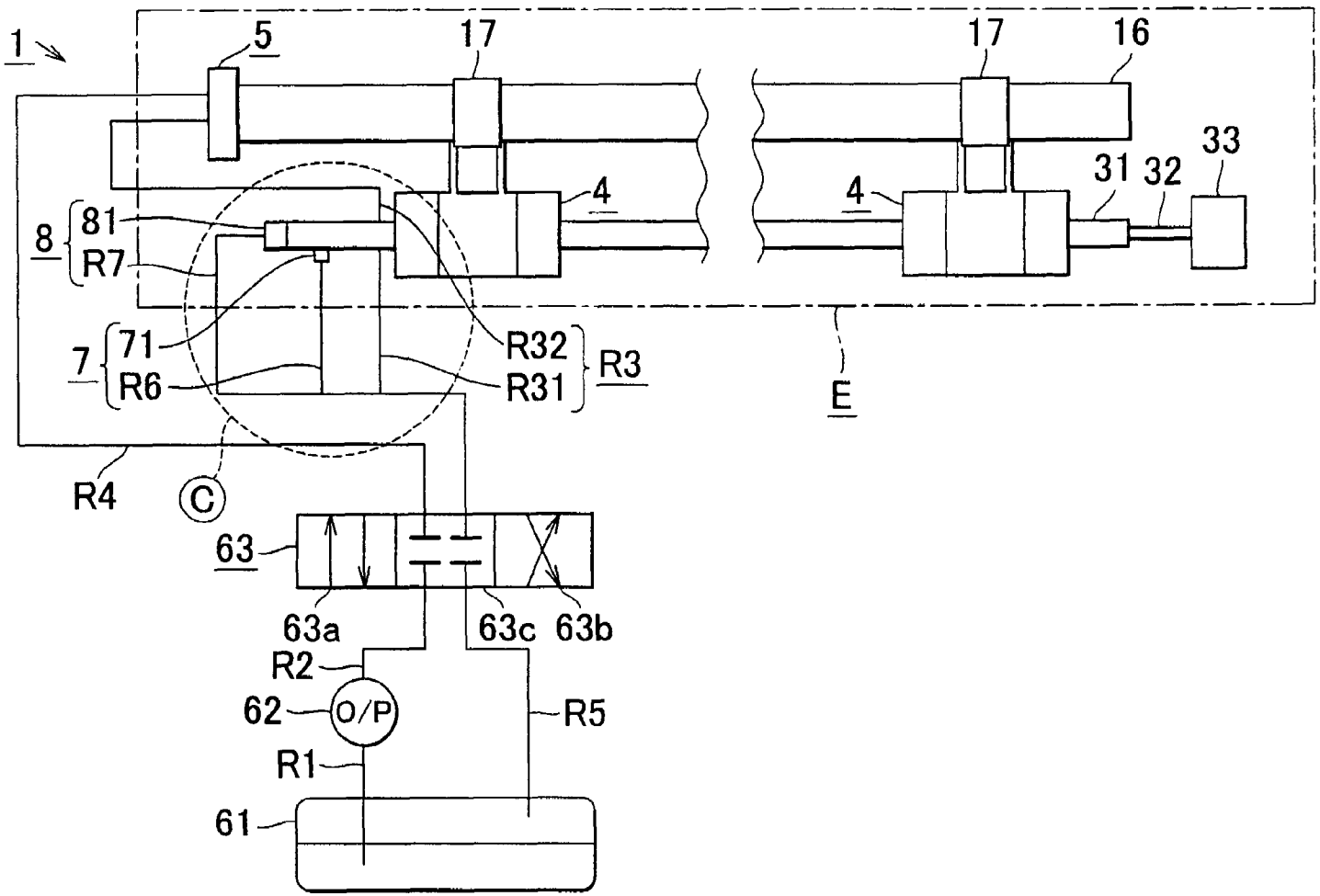
FIG. 12 is a view that shows the maximum lift amount variable mechanism and the variable valve timing mechanism in the engine of the first embodiment.

FIG. 12 shows a structural relationship between the maximum valve lift amount variable mechanism 3 and the variable valve timing mechanism 5 of the variable valve mechanism 1. The variable valve mechanism 1 is structured such that an operation state of the third supply pipe R3 (supply pipe that connects the advance pressure chamber 53 and the oil control valve 63) is selectable between an opened state and a closed state through the control shaft 32 of the maximum valve lift amount variable mechanism 3. That is, each of the rocker shaft 31 and the control shaft 32 is provided with an oil passage that constitutes a part of the lubricant supply passage as well as the third supply pipe R3.

The third supply pipe R3 is formed of a third upstream supply pipe R31 that connects the oil control valve 63 and the rocker shaft 31 (control shaft 32), and a third downstream supply pipe R32 that connects the rocker shaft 31 (control shaft 32) and the advance pressure chamber 53. The third upstream supply pipe R31 corresponds to a first advance oil passage, and the third downstream supply pipe R32 corresponds to a second advance oil passage, respectively.

The variable valve timing mechanism 5 allows the lubricant to be supplied to the advance pressure chamber 53 when the control shaft 32 is located on the position at which the third supply pipe R3 is opened (where the third upstream supply pipe R31 is communicated with the third downstream supply pipe R32). Meanwhile, the variable valve timing mechanism 5 does not allow the lubricant to be supplied to the advance pressure chamber 53 when the control shaft 32 is located on the position at which the third supply pipe R3 is closed (where the third upstream supply pipe R31 is not communicated with the third downstream supply pipe R32).

The variable valve mechanism 1 is provided with a lock mechanism 7 that restricts the area at which the control shaft 32 is allowed to move, and a reflux mechanism 8 that refluxes the lubricant in the advance pressure chamber 53 of the variable valve timing mechanism 5 into the oil pan 61 through the control shaft 32 and the rocker shaft 31.

The lock mechanism 7 is formed of the sixth supply pipe R6 (restrictive oil passage) branched from the third supply pipe R3 to be connected to the rocker shaft 31 and a lock pin 71 provided within the sixth supply pipe R6. The lock pin 71 is pressed against the rocker shaft 31 by the lubricant. The area at which the control shaft 32 is allowed to move is limited by insertion of the lock pin 71 into a groove of the control shaft 32.

The reflux mechanism 8 is formed of a check valve 81 attached to a leading end (end portion opposite to the one at the side of the shaft actuator 33) of the rocker shaft 31 and the seventh supply pipe R7 branched from the third supply pipe R3 to be connected to the check valve 81. The check valve 81 serves to pass the lubricant from the rocker shaft 31 into the seventh supply pipe R7 while preventing the flow of the lubricant from the seventh supply pipe R7 into the rocker shaft 31.

Structure of Control Shaft

Figure 13A:
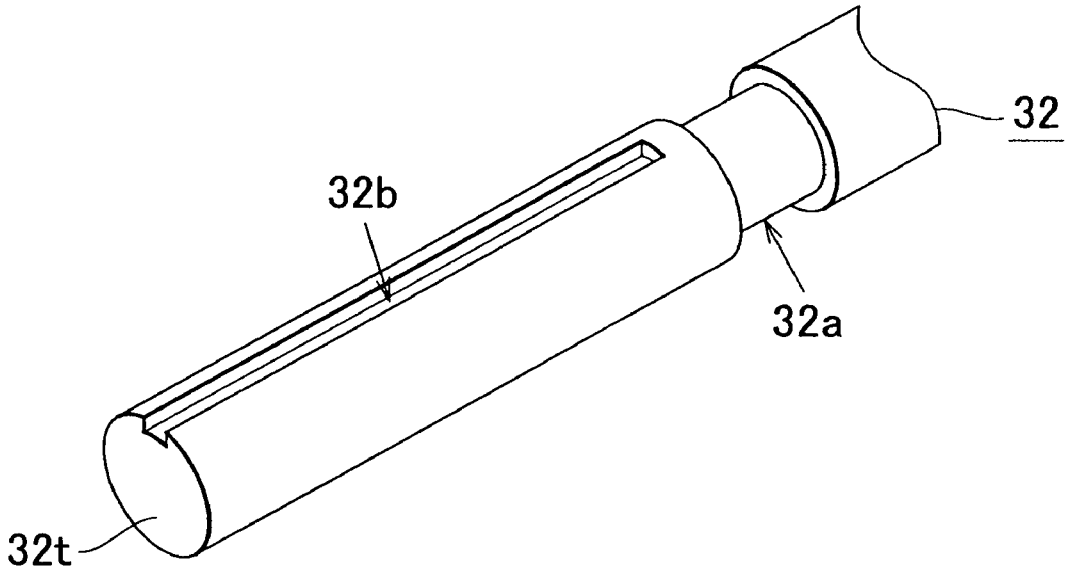
FIGS. 13A and 13B are perspective views each showing a control shaft of the variable valve mechanism in the engine of the first embodiment.
Figure 13B:
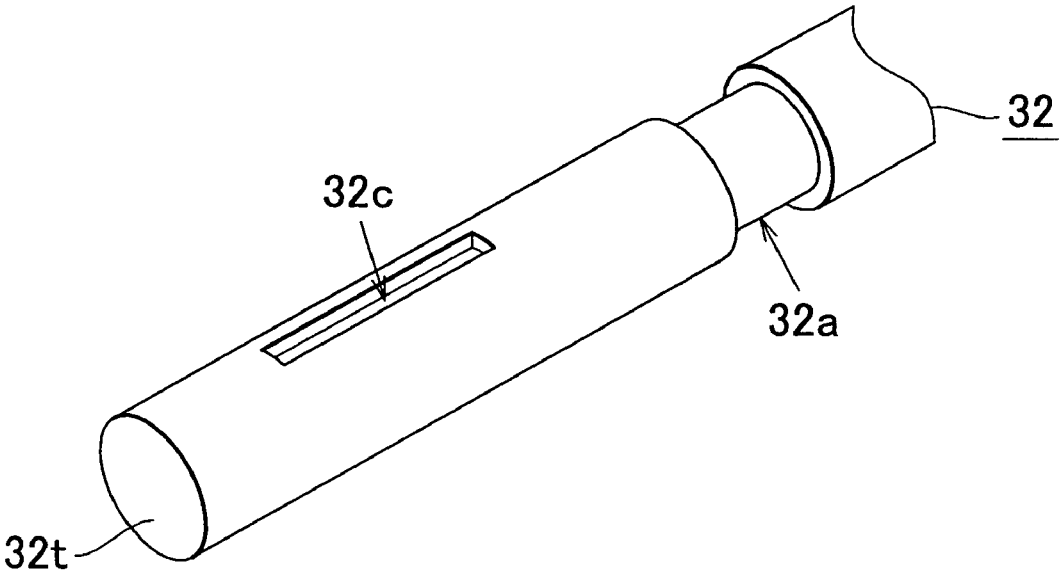

FIG. 13 represents a perspective view of a leading end (opposite to the other end connected to the actuator 33) of the control shaft 32. FIG. 13B shows the control shaft 32 in the state where it is reversed at 180° C. from its state shown in FIG. 13A.

The control shaft 32 is provided with a first oil groove 32*a* that constitutes a part of the passage that connects the advance pressure chamber 53 and the oil control valve 63, and a pin groove 32*c* connected to the sixth supply pipe R6 so as to receive an insertion of the lock pin 71, and a second oil groove 32*b* connected to the advance pressure chamber 53 via the third upstream supply pipe R31. The first oil groove 32*a* corresponds to the oil groove that constitutes a part of the advance oil passage.

The first oil groove 32*a* is formed at a position apart from the leading end surface 32*t* in the axial direction by a distance of L1. The first oil groove 32*a* is annularly formed around the circumference of the control shaft 32. That is, the portion of the control shaft 32 at which the first oil groove 32*a* is formed has a diameter smaller than that of the portion at which the first oil groove 32*a* is not formed.

The pin groove 32*c* is formed to extend in the axial direction from the position apart from the leading end surface 32*t* by the distance of L2 (<distance L1) to the position apart from the position apart from the leading end surface 32*t* by the distance of L3 (<distance L1) in the axial direction. The depth of the pin groove 32*c* is set to a value sufficient to receive the insertion of the lock pin 71. The pin groove 32*c* is formed to be closer to the leading end surface 32*t* than that first oil groove 32*a*.

The second oil groove 32*b* is formed at a position apart from the leading end surface 32*t* in the axial direction by a distance of L4 (<distance L1). The second oil groove 32*b* is formed to be closer to the leading end surface 32*t* than the first oil groove 32*a*. Each configuration (position, shape, and size) of the respective grooves may be arbitrarily changed in accordance with its relationship with the respective supply pipes and the lock pin.

Structure of Rocker Shaft

Figure 14A:
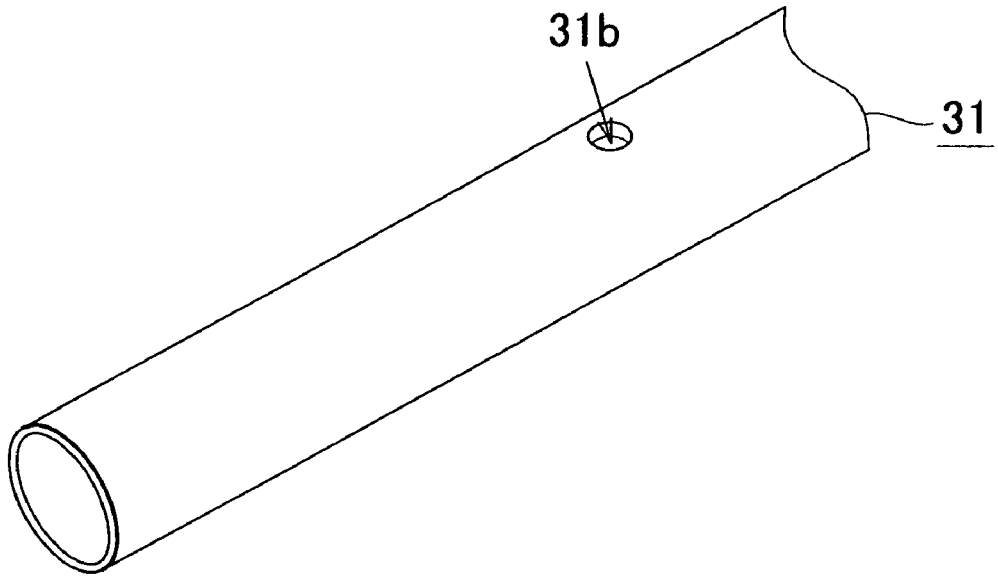
FIGS. 14A and 14B are perspective views each showing a rocker shaft of the variable valve mechanism in the engine of the first embodiment.
Figure 14B:
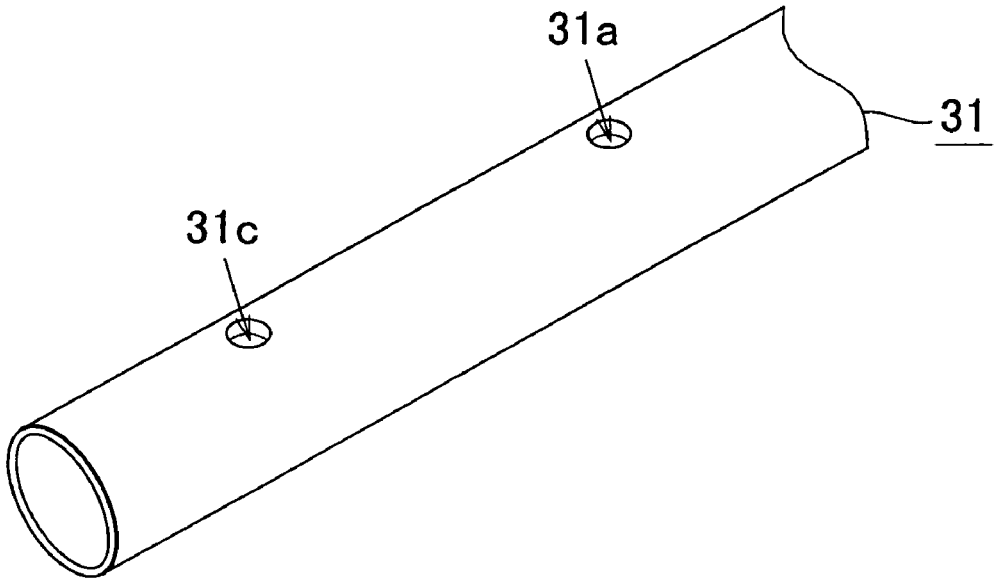

FIG. 14 shows a perspective view of a leading end (corresponding to the leading end of the control shaft 32) of the rocker shaft 31. FIG. 14B shows the rocker shaft 31 in the state where it is reversed at 180° C. from its state shown in FIG. 14A.

The rocker shaft 31 is provided with a first communication hole 31*a* that communicates the third upstream supply pipe R31 with the first oil groove 32*a*, a second communication hole 31*b* that communicates the third downstream supply pipe R32 with the first oil groove 32*a* or the second oil groove 32*b*, and a third communication hole 31*c* that communicates the sixth supply pipe R6 with the pin groove 32*c*. Each configuration (position, shape, and size) of the respective grooves may be arbitrarily changed in accordance with its relationship with the respective supply pipes and the lock pin.

Structures of Lubricant Supply Path in Rocker Shaft and Control Shaft

Figure 15:
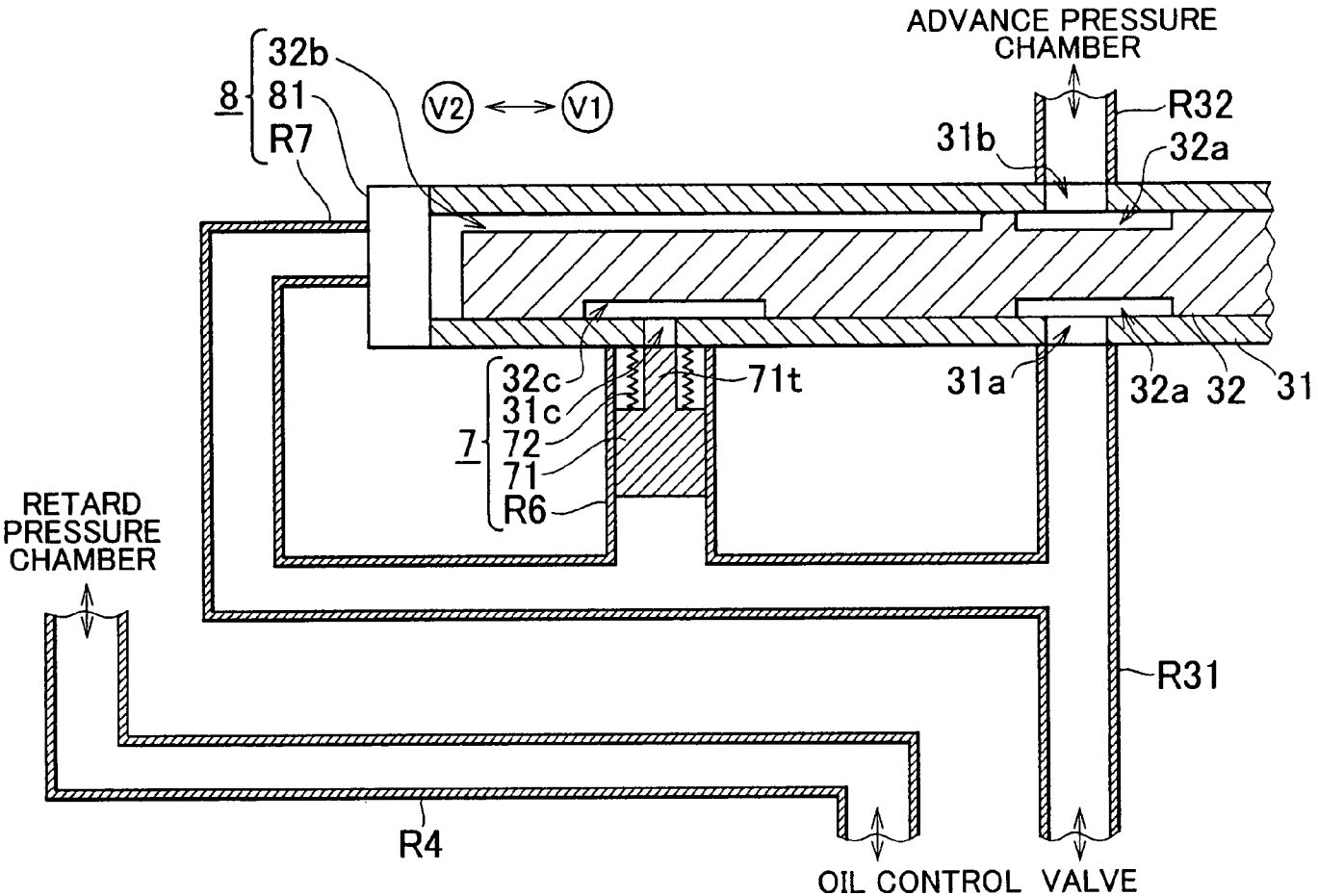
FIG. 15 is a view that shows in detail a structure of a portion C as shown in FIG. 12 of the variable valve mechanism in the engine of the first embodiment.

FIG. 15 shows a detailed structure of a portion C shown in FIG. 12.

FIG. 15 is a cross sectional view of the structure along the axis of the rocker shaft 31 and the control shaft 32. FIG. 15 shows the variable valve mechanism in the state where the control shaft 32 is moved toward the direction away from the shaft actuator 33 (direction of arrow V2) to maximum.

The third upstream supply pipe R31 is connected to the first communication hole 31*a* of the rocker shaft 31, and the third downstream supply pipe R32 is connected to the second communication hole 31*b* of the rocker shaft 31, respectively.

The communication state between the first/second communication holes 31*a*, 31*b* and the first oil groove 32*a* is selectable between a communicated state and a non-communicated state. When the first/second communication holes 31*a*, 31*b* are communicated with the first oil groove 32*a*, the third upstream/downstream supply pipes R31, R32 are held communicated with the first oil groove 32*a* such that the lubricant supply path that connects the oil control valve 63 to the advance pressure chamber 53 is formed.

The sixth supply pipe R6 is connected to the third communication hole 31*c* of the rocker shaft 31.

The relationship between the third communication hole 31*c* and the pin groove 32*c* is selectable between the communicated state and the non-communicated state in accordance with the axial direction of the control shaft 32. When the third communication hole 31*c* is communicated with the pin groove 32*c*, the lock pin 71 of the sixth supply pipe R6 may be inserted into the pin groove 32*c*.

The lock pin 71 is provided such that its protrusion 71*t* is inserted into the pin groove 32*c* through the third communication hole 31*c* at a position most downstream side of the sixth supply pipe R6 (a portion joined with the rocker shaft 31). A spring 72 (bias mechanism) serves to bias the lock pin 71 toward the direction away from the rocker shaft 31.

The seventh supply pipe R7 is connected to the inner space of the leading end of the rocker shaft 31 via the check valve 81. The second oil groove 32*b* of the control shaft 32 is also connected to the inner space of the leading end of the rocker shaft 31.

The relationship between the second oil groove 32*b* and the second communication hole 31*b* is selectable between the communicated state and the non-communicated state in accordance with the axial position of the control shaft 32. When the second oil groove 32*b* is communicated with the second communication hole 31*b*, the seventh supply pipe R7 is held communicated with the third downstream supply pipe R32. This makes it possible to feed the lubricant in the advance pressure chamber 53 to the third downstream supply pipe R32, the second oil groove 32*b*, the check valve 81, and the seventh supply pipe R7 sequentially in the aforementioned order.

When the third upstream/downstream supply pipes R31, R32 are communicated with the first oil groove 32*a*, the seventh supply pipe R7 is held non-communicated with the third downstream supply pipe R32. Meanwhile, when the third upstream/downstream supply pipes R31, R32 are not communicated with the first oil groove 32*a*, The seventh supply pipe R7 is held communicated with the third downstream supply pipe R32.

Displacement of Lock Pin

The lock pin 71 displaces in the sixth supply pipe R6 as described below.

When the pressure force of the lubricant applied to the lock pin 71 is higher than the bias force applied by the spring 72, the lock pin 71 displaces to approach the rocker shaft 31 against the bias force of the spring 72. When the advance angle of the valve timing is equal to or larger than the reference advance angle TB, the protrusion 71*t* of the lock pin 71 is held inserted into the pin groove 32*c* (lock state). When the sixth supply pipe R6 is not communicated with the pin groove 32*c*, the protrusion 71*t* is not inserted into the pin groove 32*c*.

When the pressure force of the lubricant applied to the lock pin 71 is lower than the bias force of the spring 72, the lock pin 71 displaces in the direction away from the rocker shaft 31 against the bias force of the lubricant. When the advance angle of the valve timing is smaller than the reference advance angle TB, the protrusion 71*t* of the lock pin 71 is not held inserted into the pin groove 32*c* (unlocked).

Structure of the Lubricant Supply Path

In the variable valve mechanism 1, the communication/non-communication states between the third supply pipe R3 and the first/second oil grooves 32*a*, 32*b*, and between the sixth supply pipe R6 and the pin groove 32*c* are changed in accordance with the displacement of the control shaft 32 in the axial direction.

The axial position of the control shaft 32 will be defined as described below.

[a] The axial position of the control shaft 32 that has displaced to maximum in the direction V2 is defined as a minimum lift position Pmin. At this time, the maximum valve lift amount of the intake valve 14 is held at the minimum lift amount Lmin.

[b] The axial position of the control shaft 32 that has displaced from the minimum lift position Pmin by a displacement amount MA in the direction V1 is defined as an intermediate lift position PA. At this time, the maximum valve lift amount of the intake valve 14 is held at the intermediate lift amount LA. The displacement amount MA represents the value just before a displacement amount MB (MA is smaller than the MB by an amount of unit displacement of the control shaft). That is, the intermediate lift amount LA corresponds to the largest lift amount among those smaller than the reference lift amount LB, that is, just before the reference lift amount LB.

[c] The axial position of the control shaft 32 that has displaced from the minimum lift position Pmin by the displacement amount MB in the direction V1 is defined as a reference lift position PB. At this time, the maximum valve lift amount of the intake valve 14 is held at the reference lift amount LB.

[d] The axial position of the control shaft 32 that has displaced in the direction V1 to maximum is defined as a maximum lift position Pmax. At this time, the maximum valve lift amount of the intake valve 14 is held at the maximum lift amount Lmax.

Figure 16:
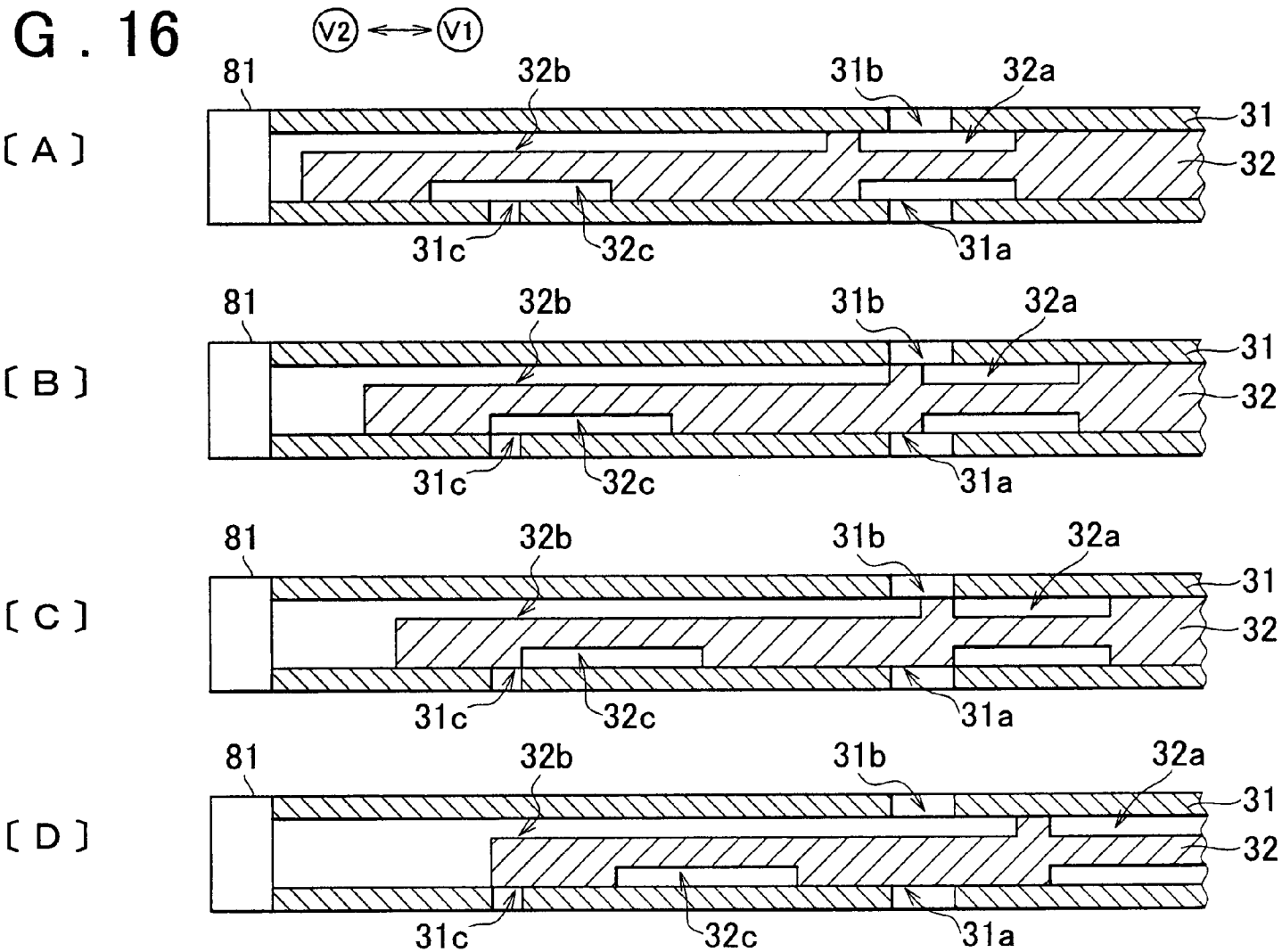
FIGS. 16A to 16D are cross sectional views each showing a cross section of the control shaft and the rocker shaft along the axis of the variable valve mechanism in the engine according to the first embodiment.

FIG. 16 shows various displacement states of the control shaft.

FIG. 16A shows the state where the control shaft 32 is held at the minimum lift position Pmin.

FIG. 16B shows the state where the control shaft 32 is held at the intermediate lift position PA.

FIG. 16C shows the state where the control shaft 32 is held at the reference lift position PB.

FIG. 16D shows the state where the control shaft 32 is held at the maximum lift position Pmax.

The communication states between the supply pipes R3, R6 and the grooves 32*a*, 32*b*, 32*c*, and operation states of the variable valve timing mechanism 5, the lock mechanism 7, and the reflux mechanism 8 in the respective states of the control shaft 32 as shown in FIGS. 16A to 16D will be described hereinafter.

[A] Minimum Lift Position Pmin:

The communication holes 31*a*, 31*b* (third upstream/downstream supply pipes R31, R32) are communicated with the first oil groove 32*a*. Accordingly the valve timing of the intake valve 14 can be advanced by supplying the lubricant to the advance pressure chamber 53.

The second communication hole 31*b* (third downstream supply pipe R32) is not communicated with the second oil groove 32*b*. Accordingly the lubricant in the advance pressure chamber 53 is not refluxed to the oil pan 61 via the second oil groove 32*b*.

The third communication hole 31*c* (sixth supply pipe R6) is communicated with the pin groove 32*c*. Accordingly the lock pin 71 is held inserted into the pin groove 32*c* when the advance angle of the valve timing is equal to or larger than the reference advance angle TB.

[B] Intermediate Lift Position PA

The communication states between the supply pipes and the grooves, and the operation states of the variable valve timing mechanism 5 and the lock mechanism 7 are the same as those described in the aforementioned section [A].

[C] Reference Lift Position PB

The first communication hole 31*a* (third upstream supply pipe R31) is not communicated with the first oil groove 32*a*. As a result, the lubricant cannot be supplied to the advance pressure chamber 53, and accordingly the valve timing of the intake valve 14 cannot be advanced.

The second communication hole 31*b* (third downstream supply pipe R32) is communicated with the second oil groove 32*b*. Accordingly the lubricant in the advance pressure chamber 53 is refluxed to the oil pan 61 via the second oil groove 32*b*.

The third communication hole 31*c* (sixth supply pipe R6) is not communicated with the pin groove 32*c*. Accordingly the lock pin 71 is not inserted into the pin groove 32*c* even when the advance angle of the valve timing is equal to or larger than the reference advance angle TB.

[D] Maximum Lift Position Pmax

The communication states between the supply pipes and the grooves, and the operation states of the variable valve timing mechanism 5, the lock mechanism 7 and the reflux mechanism 8 are the same as those described in the section [C].

When the axial position of the control shaft 32 is in the range between the minimum lift position Pmin and the intermediate lift position PA (in the range of the maximum valve lift amount between the minimum lift amount Lmin and the intermediate lift amount LA), the operation states of the variable valve timing mechanism 5, the lock mechanism 7 and the reflux mechanism 8 are the same as those described in the sections [A] and [B]. When the axial position of the control shaft 32 is in the range between the reference lift position PB and the maximum lift position Pmax (in the range of the maximum valve lift amount between the reference lift amount LB and the maximum lift amount Lmax), the operation states of the variable valve timing mechanism 5, the lock mechanism 7 and the reflux mechanism 8 are the same as those described in the sections [C] and [D].

Lubricant Flow State 1

Referring to FIG. 17, the flow state of the lubricant in the case where the maximum valve lift amount is in the range between the minimum lift amount Lmin to the intermediate lift amount LA will be described. The arrow on each path shown in FIG. 17 represents the lubricant flow direction.

[1] Lubricant Flow at Advance

Figure 17A:
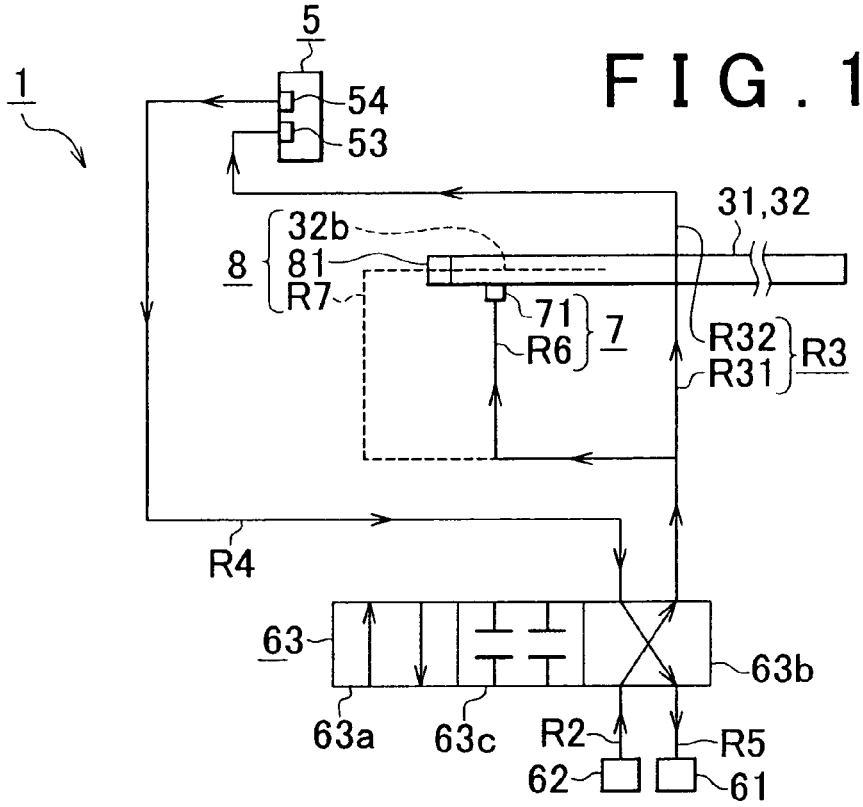
FIGS. 17A and 17B are views each showing the flow path of the lubricant in the variable valve mechanism in the engine of the first embodiment.

Upon advance of the valve timing, the lubricant flows as shown in FIG. 17A.

[a] The lubricant that has been press fed by the oil pump 62 flows through the second supply pipe R2, the oil control valve 63, the third upstream supply pipe R31, the control shaft 32 (first oil groove 32*a*), and the third downstream supply pipe R32 sequentially in the aforementioned order. The lubricant is further supplied to the sixth supply pipe R6 via the third upstream supply pipe R31.

[b] The lubricant in the retardation pressure chamber 54 is refluxed to the oil pan 61 via the fourth supply pipe R4, the oil control valve 63, and the fifth supply pipe R5. The lubricant by the amount corresponding to the amount of the lubricant that has been fed into the advance pressure chamber 53 is further refluxed to the oil pan 61 via the aforementioned flow path.

[2] Lubricant Flow at Retardation

Figure 17B:
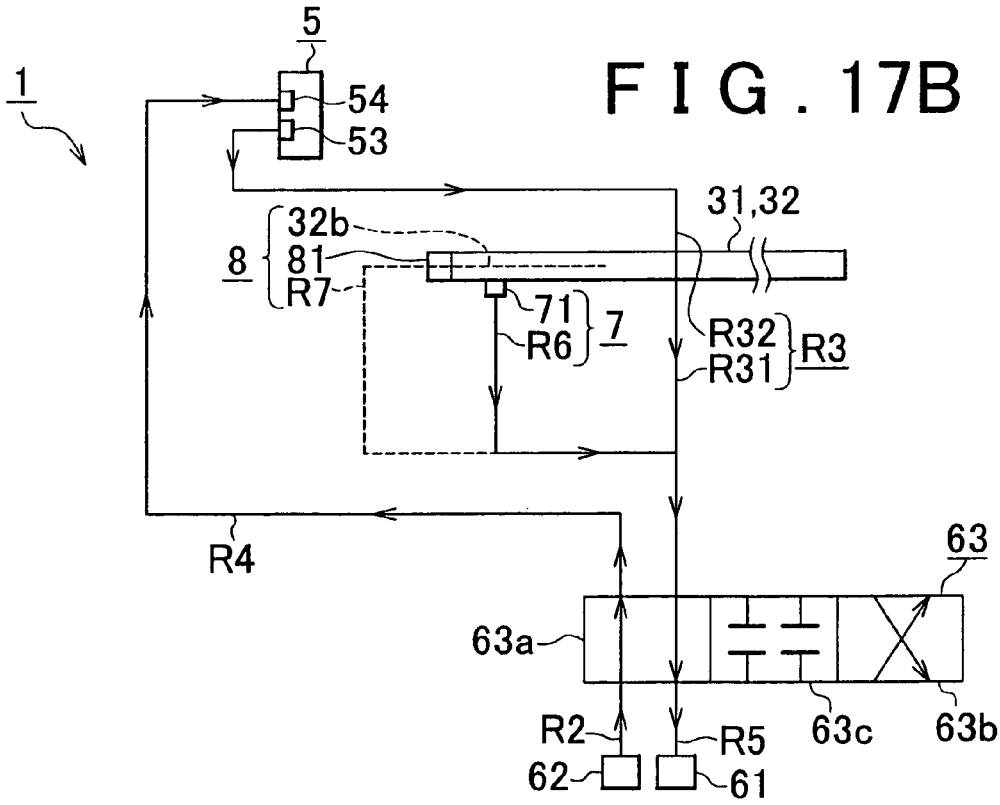

Upon retardation of the valve timing, the lubricant flows as shown in FIG. 17B.

[a] The lubricant that has been press fed by the oil pump 62 flows into the retardation pressure chamber 54 through the second supply pipe R2, the oil control valve 63, and the fourth supply pipe R4 sequentially in the aforementioned order.

[b] The lubricant in the advance pressure chamber 53 is refluxed to the oil pan 61 through the third downstream supply pipe R32, the control shaft 32 (first oil groove 32*a*), the third upstream supply pipe R31, the oil control valve 63, and the fifth supply pipe R5 sequentially in the aforementioned order. The lubricant flowing through the sixth supply pipe R6 is further refluxed to the oil pan 61. The lubricant by the amount corresponding to the amount of the lubricant that has been fed into the retardation pressure chamber 54 is refluxed via the aforementioned flow path of the lubricant.

Lubricant Flow State 2

Referring to FIG. 18, the lubricant flow state when the maximum valve lift amount is in the range between the reference lift amount LB and the maximum lift amount Lmax will be described. In FIG. 18, the solid line represents the path through which the lubricant flows, and the dashed line represents the path through which the lubricant does not flow. The arrow on the path shown in FIG. 18 represents the lubricant flow direction.

[1] Lubricant Flow at Advance

Figure 18A:
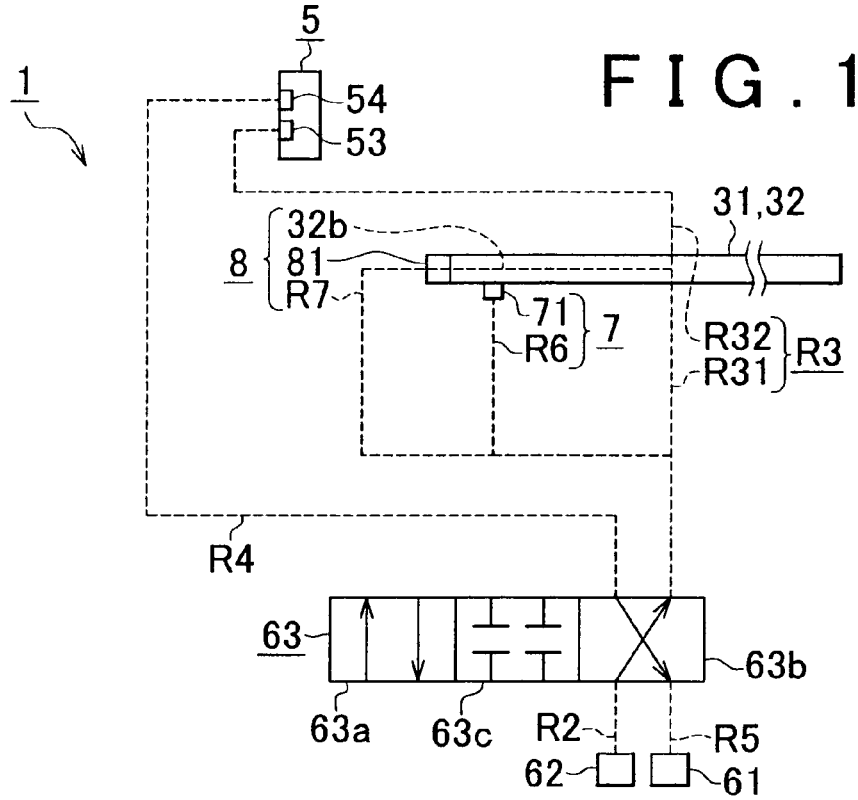
FIGS. 18A and 18B are views each showing the flow path of the lubricant in the variable valve mechanism in the engine of the first embodiment.

When the maximum valve lift amount is set to be in the range between the reference lift amount LB and the maximum lift amount Lmax, the valve timing cannot be advanced. Accordingly the lubricant resides in the flow path as shown in FIG. 18A.

[2] Lubricant Flow at Retardation

Figure 18B:
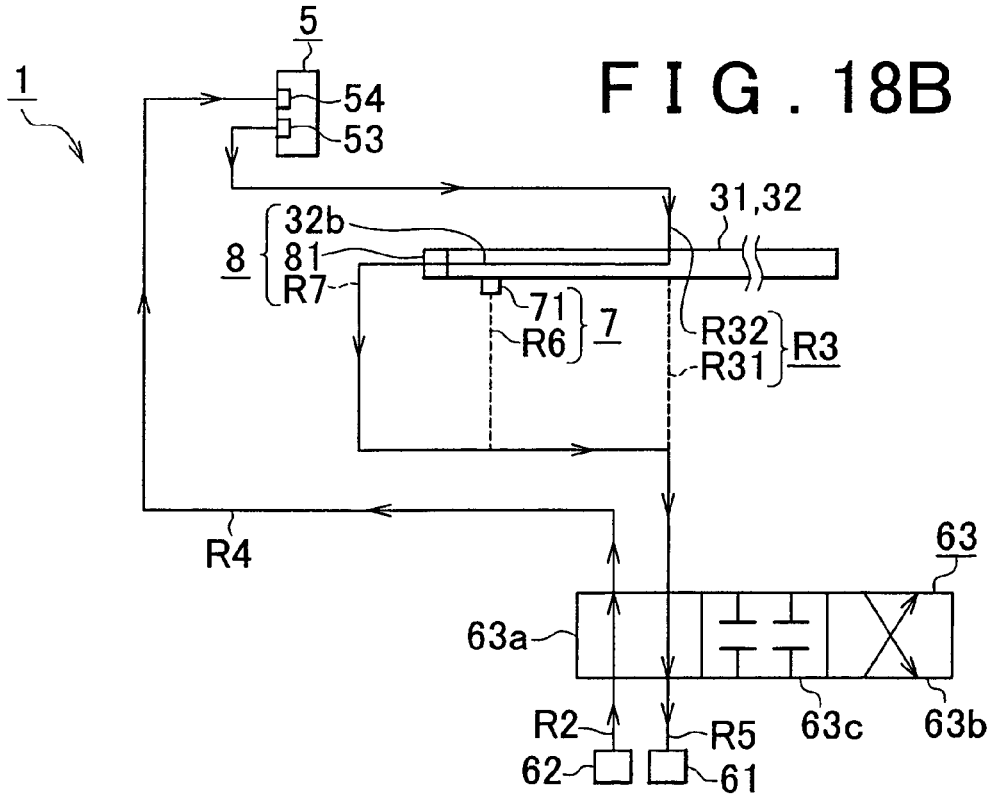

Upon retardation of the valve timing, the lubricant flows as shown in FIG. 18B.

[a] The lubricant that has been press fed by the oil pump 62 flows through the second supply pipe R2, the oil control valve 63, and the fourth supply pipe R4 sequentially so as to be supplied to the retardation pressure chamber 54.

[b] The lubricant in the advance pressure chamber 53 is refluxed to the oil pan 61 through the third downstream supply pipe R32, the control shaft 32 (second oil groove 32*b*), check valve 81, the seventh supply pipe R7, the third upstream supply pipe R31, the oil control valve 63, the fifth supply pipe R5 sequentially. The lubricant by the amount corresponding to the amount of the lubricant that has been fed into the retardation pressure chamber 54 is refluxed to the oil pan 61 via the flow path as aforementioned.

Restriction of Movement of Control Shaft

The axial movement of the control shaft 32 is restricted by the lock pin 71 as described below.

When the axial position of the control shaft 32 is in the range between the minimum lift position Pmin and the intermediate lift position PA, the lock pin 71 is inserted into the pin groove 32*c* such that the control shaft 32 is not moved toward the direction V1 over the intermediate lift position PA. That is, when the control shaft 32 is locked, the range (maximum valve lift amount changeable range) in which the maximum valve lift amount can be changed is limited to the range between the minimum lift amount Lmin and the intermediate lift amount LA (minimum lift amount Lmin≦maximum valve lift amount L<reference lift amount LB).

Meanwhile when the axial position of the control shaft 32 is in the range between the reference lift position PB and the maximum lift position Pmax, the lock pin 71 cannot be inserted into the pin groove 32*c*. Accordingly the control shaft 32 is allowed to move toward the direction either V1 or V2. That is, when the control shaft 32 is unlocked, the maximum valve lift amount changeable range is set to be in the range between the minimum lift amount Lmin and the maximum lift amount Lmax.

Operation Mode of Variable Valve Mechanism

Figure 19:
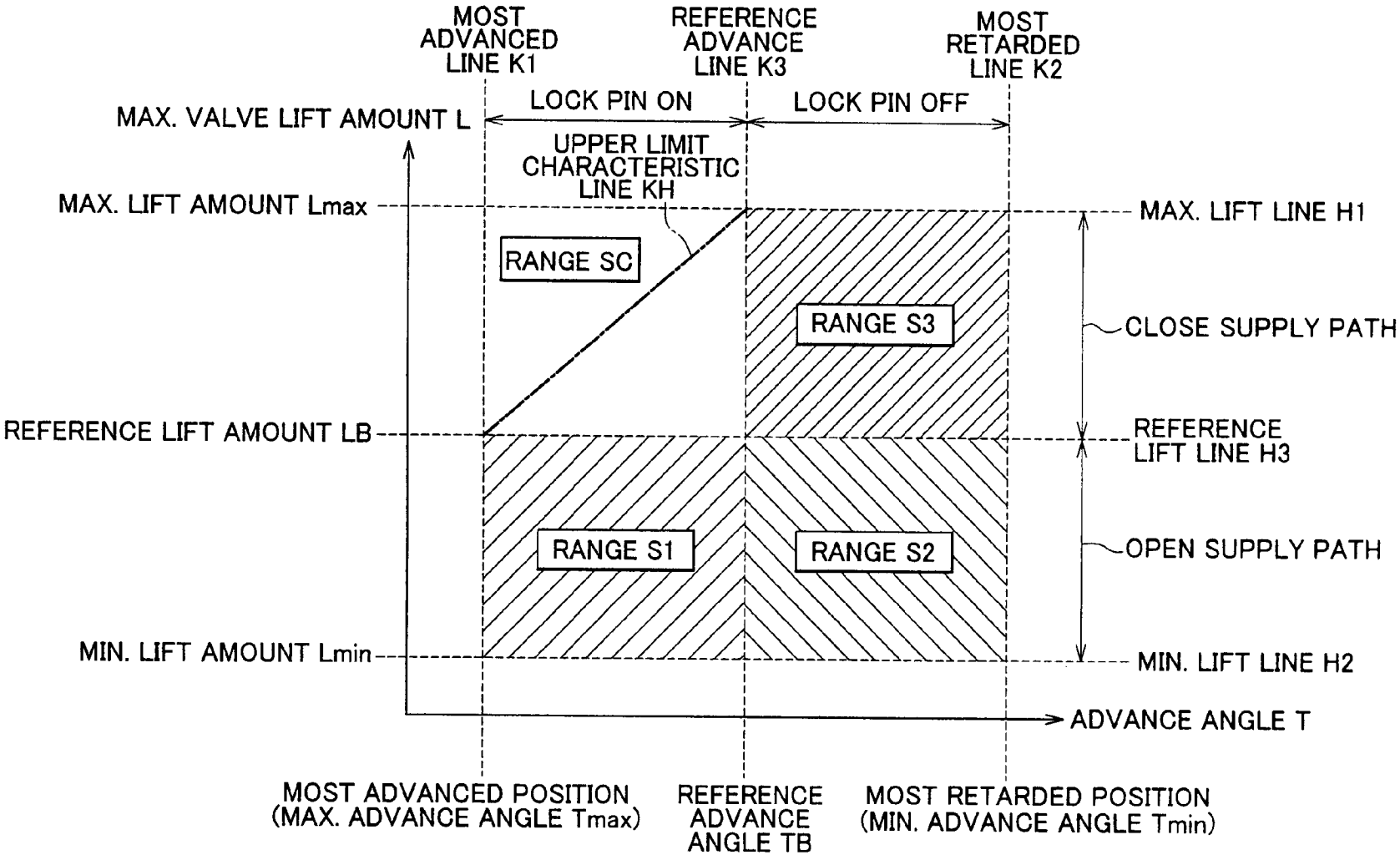
FIG. 19 is a view that shows a relationship between the advance angle and the maximum valve lift amount.

FIG. 19 is a diagram that represents a relationship between the advance angle and the maximum valve lift amount.

The variable valve mechanism 1 is operable between the first area S1 and the third area S3.

The first area S1 is defined by the most advanced angle line K1, the reference lift line H3, the reference advance angle line K3 and the minimum lift line H2. With respect to the valve characteristics in the first area S1, the maximum valve lift amount L is in the range from the minimum lift amount Lmin to the reference lift amount LB. The advance angle T is in the range from the reference advance angle TB to the maximum advance angle Tmax.

The second area S2 is defined by the reference advance angle line K3, the reference lift line H3, the most retarded angle line K2, and the minimum lift line H2. With respect to the valve characteristics in the second area S2, the maximum valve lift amount L is in the range from the minimum lift amount Lmin to the value just before the reference lift amount LB. The advance angle T is in the range from the minimum advance angle Tmin to the reference advance angle TB.

The third area S3 is defined by the reference advance angle line K3, the maximum lift line H1, the most retarded angle line K2 and the reference lift line H3. With respect to the valve characteristics in the third area S3, the maximum valve lift amount L is in the range from the reference lift amount LB to the maximum lift amount Lmax. The advance angle T is in the range from the minimum advance angle Tmin to the reference advance angle TB.

The operation state of the variable valve mechanism 1 in the respective areas as mentioned above will be described hereinafter.

[1] First Area S1

In the first area S1, as the third communication hole 31*c* (sixth supply pipe R6) is communicated with the pin groove 32*c*, and the advance angle is equal to or larger than the reference advance angle TB, the control shaft 32 is maintained in the locked state. Accordingly the area in which the control shaft 32 is moved is limited to the one between the minimum lift position Pmin and the intermediate lift position PA. That is, the range in which the maximum valve lift amount L is changed is limited to the one between the minimum lift amount Lmin and the intermediate lift amount LA (minimum lift amount Lmin≦maximum valve lift amount L<reference lift amount LB).

In the first area S1, the communication holes 31*a*, 31*b* (third upstream/downstream supply pipes R31, R32) are communicated with the first oil groove 32*a*. The range in which the advance angle can be changed (the advance angle T changeable range) is not restricted. When the advance angle T is changed to the value smaller than the reference advance angle TB, the operation area is shifted from the first area to the second area.

[2] Second Area S2

In the second area S2, the third communication hole 31*c* (sixth supply pipe R6) is communicated with the pin groove 32*c*. However, as the advance angle T is smaller than the reference advance angle TB, the control shaft 32 is maintained unlocked. Accordingly the range in which the control shaft 32 is moved is not limited. When the maximum valve lift amount L is changed to the value equal to or larger than the reference lift amount LB, the operative area is shifted from the second area S2 to the third area S3 as described below.

In the second area S2, as the communication holes 31*a*, 31*b* (third upstream/downstream supply pipes R31, R32) are communicated with the first oil groove 32*a*, the range in which the advance angle T is changed is not limited. When the advance angle T is changed to the value equal to or larger than the reference advance angle TB, the operative area is shifted from the second area S2 to the first area S1.

[3] Third Area S3

In the third area S3, as the third communication hole 31*c* (sixth supply pipe R6) is not communicated with the pin groove 32*c*, the control shaft 32 is maintained unlocked. Accordingly the area in which the control shaft 32 is moved is not limited. When the maximum valve lift amount L is changed to the value smaller than the reference lift amount LB, the operative area is shifted from the third area S3 to the second area S2.

In the third area S3, as the first communication hole 31*a* (third upstream supply pipe R31) is not communicated with the first oil groove 32*a*, the advance angle T cannot be changed to the value to the side of the maximum advance angle Tmax. That is, the range in which the advance angle T is changed is limited to the one between the value at that time and the minimum advance angle Tmin.

Effects of the Embodiment of the Invention

As has been described, the variable valve mechanism of the engine according to the first embodiment provides effects as described below.

When the variable valve mechanism 1 is operated in the first area S1, the range in which the control shaft 32 moves is limited by the lock pin 71, and accordingly the range in which the maximum valve lift amount L is changed is limited to the one between the minimum lift amount Lmin and the value (intermediate lift position PA) just before the reference lift amount LB. When the advance angle T is equal to or larger than the reference advance angle TB, the maximum valve lift amount L is not changed to the value equal to or larger than the upper limit lift amount Llim. Then it is possible to avoid the contact between the piston and the intake valve 14 owing to the change in the maximum valve lift amount.

The variable valve mechanism has a structure in which the variable valve timing mechanism 5 is linked with the maximum valve lift amount variable mechanism 3 such that the range in which the control shaft 32 is changed is limited through the lubricant supplied to the advance pressure chamber 53. Accordingly the range in which the maximum valve lift amount is changed may be appropriately limited.

When the variable valve mechanism 1 according to the embodiment of the invention is operated in the third area S3, the control shaft 32 serves to close the third supply pipe R3 (advance oil passage) such that the state in which the valve timing cannot be advanced is maintained. When the maximum valve lift amount L is equal to or larger than the reference lift amount LB, the advance angle T cannot be changed to the value equal to or larger than the upper limit advance angle TB. This makes it possible to avoid the contact between the piston and the intake valve 14 owing to the change in the advance angle.

The variable valve mechanism 1 is structured to have the maximum valve lift amount variable mechanism 3 linked with the variable valve timing mechanism 5 so as to close the oil passage for advance through the movement of the control shaft 32. This makes it possible to appropriately limit the range in which the advance angle is changed.

In the variable valve mechanism 1 according to the embodiment, when the maximum valve lift amount L is smaller than the reference lift amount LB, the advance angle T can be changed in the range between the maximum advance angle Tmax and the minimum advance angle Tmin. Accordingly the maximum valve lift amount L is set to the minimum lift amount Lmin (or the value close thereto), and the advance angle T is set to the maximum advance angle Tmax (or the value close thereto). This makes it possible to open the intake valve 14 at an earlier stage in the state where the maximum valve lift amount is small. When the aforementioned valve characteristics are selected, the reverse flow of the mixture to the intake port may be restricted, thus improving the fuel efficiency.

Modified Example

The first embodiment may be applied to the form by changing various portions as described below.

In the first embodiment, the structure of the variable valve mechanism 1 is not limited to the one as described above. It may have the arbitrary structure so long as the conditions A and B are established.

[A] When the maximum valve lift amount L is equal to or larger than the reference lift amount LB, the third supply pipe R3 (advance oil passage) is closed by the control shaft 32.

[B] When the advance angle T is equal to or larger than the reference advance angle TB, the range in which the control shaft 32 is moved is limited to the one between the minimum lift amount Lmin and the lift amount (intermediate lift amount LA) just before the reference lift amount LB

Second Embodiment

The second embodiment will be described referring to FIGS. 20 and 21. The variable valve mechanism according to the embodiment is substantially the same as that described in the first embodiment except that the lock mechanism is removed from the variable valve mechanism according to the first embodiment.

Figure 20:
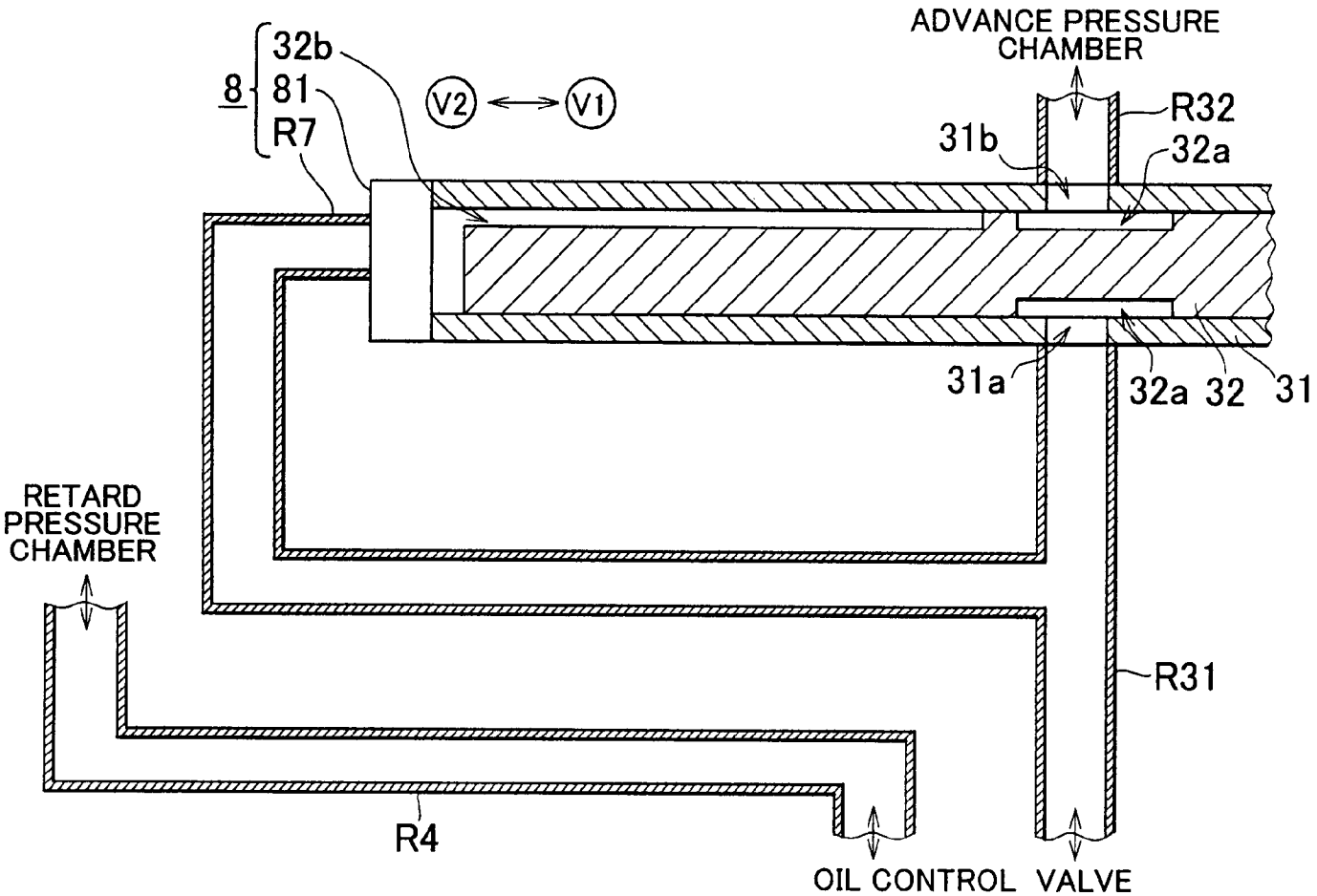
FIG. 20 is a view that shows a structure of a variable valve mechanism in an engine of a second embodiment according to the invention with respect to a portion corresponding to the portion C shown in FIG. 12.

FIG. 20 shows a structure of variable valve mechanisms according to the embodiment corresponding to the enlarged view of the structure of the portion C as shown in FIG. 12. The variable valve mechanism according to the embodiment has the same structure as that of the first embodiment except the one that will be described below.

Operation State of Variable Valve Mechanism

Figure 21:
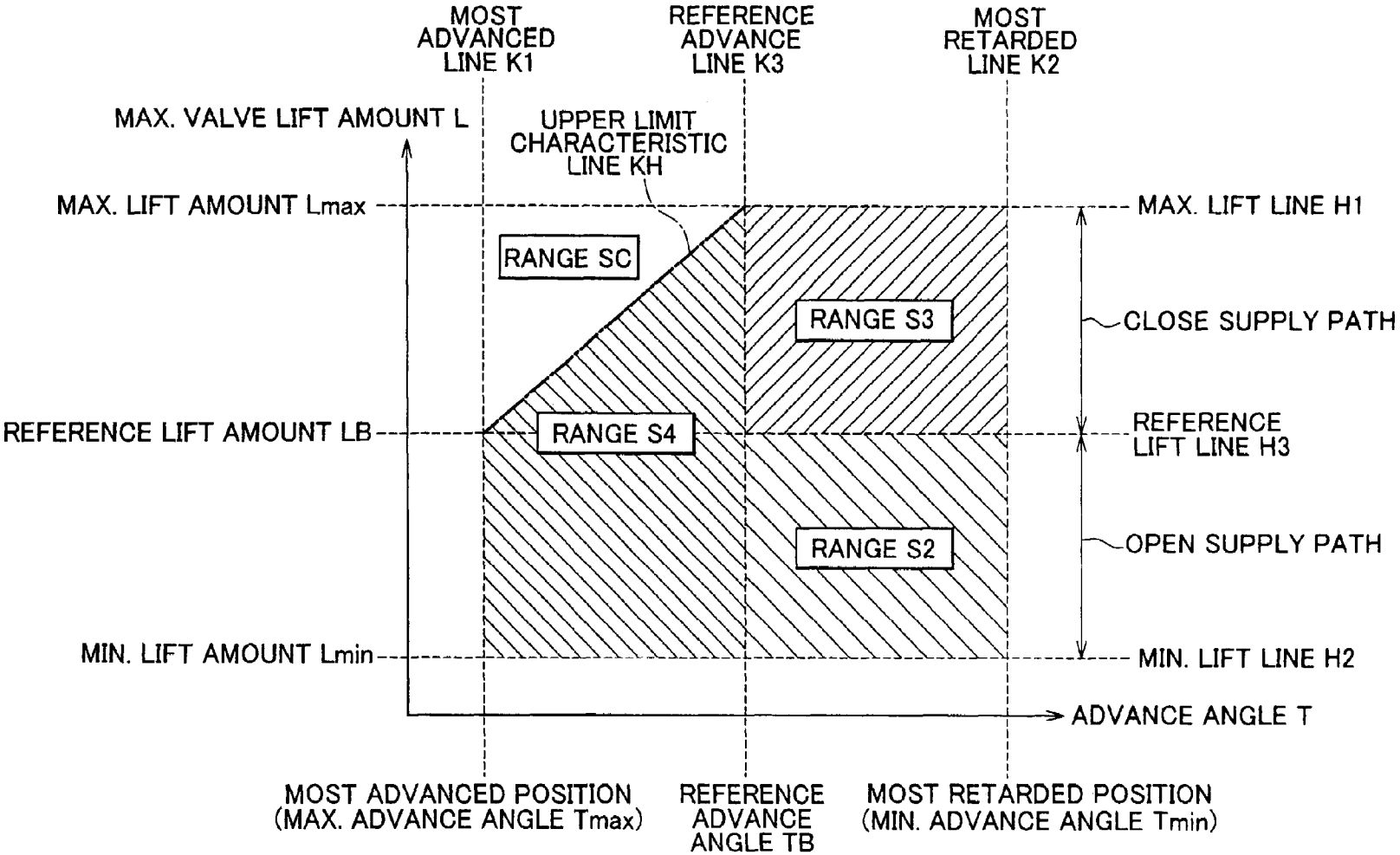
FIG. 21 is a view that shows a relationship between the advance angle and the maximum valve lift amount.

FIG. 21 is a diagram that represents a relationship between the advance angle and the maximum valve lift amount.

The variable valve mechanism 1 is allowed to be operated between the second area S2 and the fourth area S4.

The fourth area S4 is defined by the upper limit characteristic curve KH, the reference advance angle line K3 and the minimum lift line H2. That is, the fourth area S4 corresponds to the area obtained by adding the first area S1 to the area defined by the upper limit characteristic curve KH, the reference advance angle line K3 and the reference lift line H3. With respect to the valve characteristics in the fourth area S4, the maximum valve lift amount L is in the range between the minimum lift amount Lmin and the upper limit lift amount Llim. The advance angle T is in the range between the reference advance angle TB and the maximum advance angle Tmax. The upper limit lift amount Llim represents the maximum valve lift amount on the upper limit characteristic curve KH.

In the fourth area S4, as the communication holes 31*a*, 31*b* (third upstream/downstream supply pipes R31, R32) are communicated with the first oil groove 32*a*, the range in which the advance angle T is changed is not limited. When the advance angle T is changed to the value that is smaller than the reference advance angle TB, the operative area is shifted from the fourth area S4 to the second area S2 or the third area S3.

In the fourth area S4, the electronic control unit 9 controls the axial position of the control shaft 32 such that the maximum valve lift amount L is smaller than the upper limit lift amount Llim. That is, the electronic control unit 9 prevents the maximum valve lift amount L from being changed to the value equal to or larger than the upper limit lift amount Llim when the variable valve mechanism 1 is operated in the fourth area S4.

Effects of the Embodiment

As has been described in detail, the variable valve mechanism of the engine according to the second embodiment provides the following effects in addition to the aforementioned effects (3) to (5).

When the variable valve mechanism 1 is operated in the fourth area S4, the range in which the maximum valve lift amount L is limited to the one between the minimum lift amount Lmin and the upper limit lift amount Llim by the electronic control unit 9. When the advance angle T is equal to or larger than the reference advance angle TB, the maximum valve lift amount L is not changed to the value equal to or larger than the upper limit lift amount Llim. Accordingly it is possible to avoid the contact between the piston and the intake valve owing to the change in the maximum valve lift amount.

Modified Example

The second embodiment may be modified in the form as described below.

The structure of the variable valve mechanism 1 is not limited to the one as described above. It may be structured in arbitrary forms so long as the following conditions [A] and [B] are satisfied.

[A] When the maximum valve lift amount L is equal to or larger than the reference lift amount LB, the control shaft 32 serves to close the third supply pipe R3 (advance oil passage).

[B] When the variable valve mechanism 1 is operated in the fourth area S4, the electronic control unit 9 controls the shaft actuator 33 (control shaft 32) such that the range in which the maximum valve lift amount L is changed is limited to the one between the minimum lift amount Lmin and the upper limit lift amount Llim.

Third Embodiment

A third embodiment of the invention will be described referring to FIGS. 22 and 23. A variable valve mechanism of the embodiment has a structure that is substantially the same as that in the first embodiment except that the control shaft is not linked with the advance oil passage.

Figure 22:
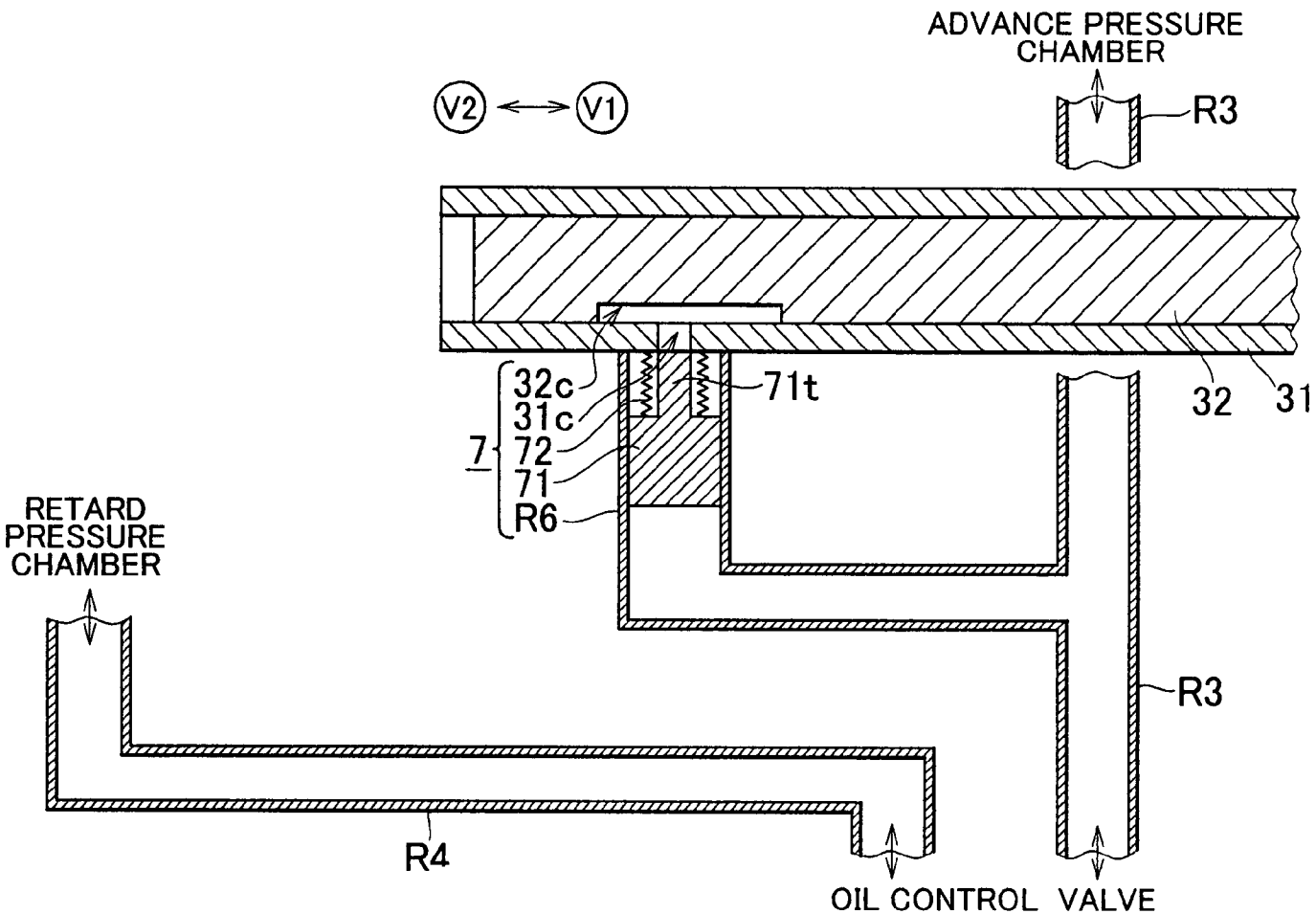
FIG. 22 is a view that shows a structure of a variable valve mechanism in an engine of a third embodiment according to the invention with respect to a portion corresponding to the portion C shown in FIG. 12.

FIG. 22 shows the structure of the variable valve mechanism according to the embodiment corresponding to the enlarged structure of the portion C shown in FIG. 12. The variable valve mechanism according to the embodiment has the same structure as that of the first embodiment except the one that will be described below.

Operation Mode of Variable Valve Mechanism

Figure 23:
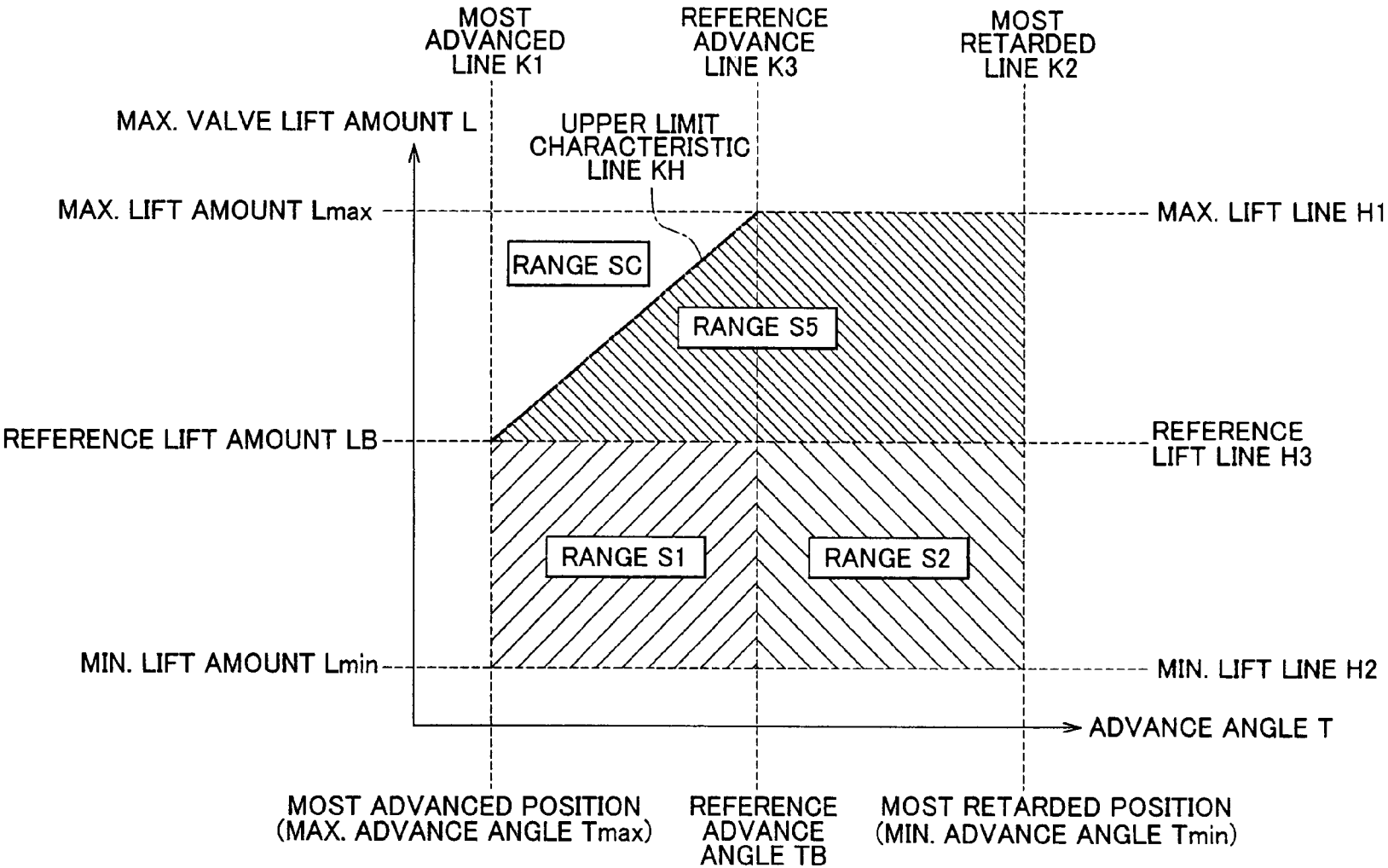
FIG. 23 is a view that shows a relationship between the advance angle and the maximum valve lift amount.
Figure 24:
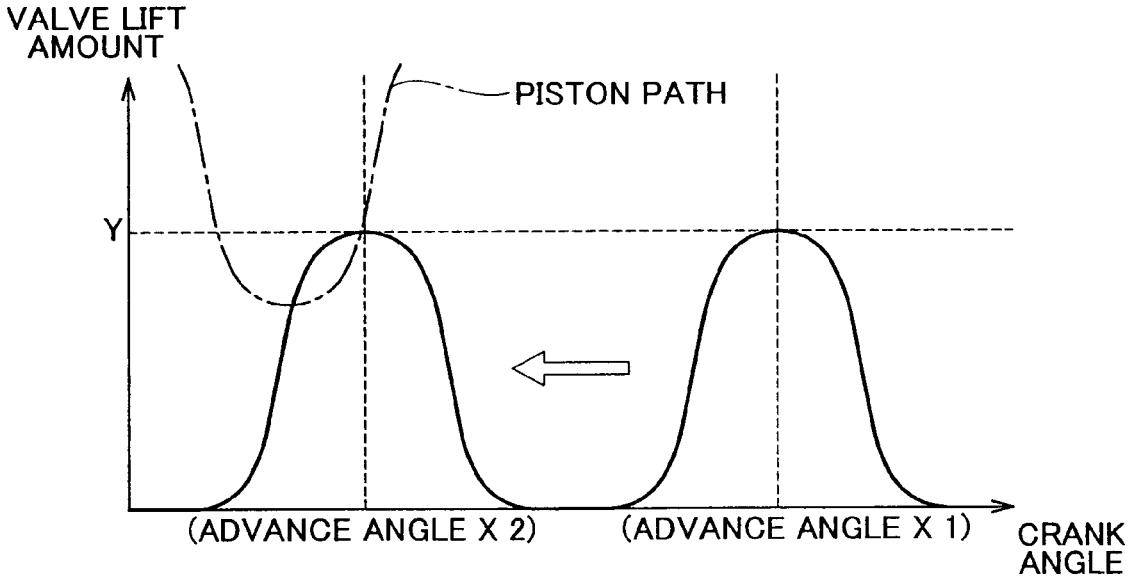
FIG. 24 is a view that shows a relationship between a crank angle and the valve lift amount.

FIG. 23 is a diagram that represents a relationship between the advance angle and the maximum valve lift amount. The variable valve mechanism 1 is operated in the first, second, and fifth areas S1, S2, and S5.

The fifth area S5 is defined by the upper limit characteristic curve KH, the most retarded angle line K2 and the reference lift line H3. That is, the fifth area S5 corresponds to the area obtained by adding the third area S3 to the one defined by the upper limit characteristic curve KH, the reference advance angle line K3, and the reference lift line H3. With respect to the valve characteristics in the fifth area S5, the maximum valve lift amount L is in the range between the reference lift amount LB and the maximum lift amount Lmax. The advance angle T is in the range between the minimum advance angle Tmin and the upper limit advance angle Tlim. The upper limit advance angle Tlim represents the advance angle on the upper limit characteristic curve KH.

In the fifth area S5, as the maximum valve lift amount L is equal to or larger than the reference lift amount LB, the control shaft 32 is maintained unlocked. When the maximum valve lift amount is changed to the value smaller than the reference lift amount LB, the operative area is shifted from the fifth area S5 to the first area S1 or the second area S2.

In the fifth area S5, the electronic control unit 9 controls the variable valve timing mechanism 5 such that the advance angle T is smaller than the upper limit advance angle Tlim. That is, the electronic control unit 9 prevents the advance angle T from being changed to the value equal to or larger than the upper limit advance angle Tlim when the variable valve mechanism 1 is operated in the fifth area S5.

Effect of the Embodiment

As has been described in detail, the variable valve mechanism of the engine according to the third embodiment provides the following effect in addition to the aforementioned effects (3) to (5).

When the variable valve mechanism 1 is operated in the fifth area S5, the electronic control unit 9 limits the range in which the advance angle T is changed between the minimum advance angle Tmin and the upper limit advance angle Tlim. Accordingly the advance angle T is not changed to the value equal to or larger than the upper limit advance angle Tlim when the maximum valve lift amount L is equal to or larger than the reference lift amount LB. This makes it possible to avoid the contact between the piston and the intake valve resulting from the change in the advance angle.

Modified Example

The third embodiment may be modified in the form as described below.

The structure of the variable valve mechanism 1 according to the third embodiment is not limited to the structure as described above. It may be structured in arbitrary forms so long as the following conditions [A] and [B] are satisfied.

[A] When the advance angle T is equal or larger than the reference advance angle TB, the lubricant that flows through the advance oil passage limits the range in which the control shaft 32 moves between the minimum lift amount Lmin and the lift amount just before the reference lift amount LB (intermediate lift amount LA).

[B] When the variable valve mechanism 1 is operated in the fifth area S5, the electronic control unit 9 controls the variable valve timing mechanism 5 such that the range in which the advance angle T is changed is limited to the one between the minimum advance angle Tmin and the upper limit advance angle Tlim.

Other Embodiments

The elements that may be modified in the variable valve mechanism according to any one of the aforementioned embodiments and examples will be described hereinafter.

In the first and the second embodiments, the check valve 81 is used in the reflux mechanism 8. However, the check valve 81 may be replaced by an electromagnetic valve that switches the operation state of the seventh supply pipe R7 between the opened and closed state. In this case, the electromagnetic valve is normally maintained in the closed state. When the maximum valve lift amount L is in the range between the reference lift amount LB and the maximum lift amount Lmax, the electromagnetic valve is opened based on the retarded valve timing. At this time, the lubricant by the amount corresponding to the amount of the lubricant that flows into the retardation pressure chamber 54 is refluxed to the oil pan 61 through the seventh supply pipe R7.

In the first and the second embodiments, the lubricant in the advance pressure chamber 53 is refluxed to the oil pan 61 through the reflux mechanism 8. However, the lubricant may be refluxed by the mechanism other than the reflux mechanism 8. That is, the lubricant may be refluxed by the other mechanism without using the check valve 81, seventh supply pipe R7 and the second oil groove 32*b* of the control shaft 32.

For example, a reflux mechanism formed of a communication pipe that connects the third downstream/upstream supply pipes R32 and R31, and the electromagnetic valve that switches the operation thereof between the opened and closed states may be employed. In this case, switching of the electromagnetic valve is performed in the same way as in the aforementioned modified example, and accordingly the valve timing may be appropriately retarded.

In the state where the maximum valve lift amount L is in the range between the reference lift amount LB and the maximum lift amount Lmax, the lubricant in the advance pressure chamber 53 is refluxed only when the valve timing is retarded, and at a time other than the retardation, the lubricant is held in the flow path. The aforementioned structure may be employed in place of the reflux mechanism 8.

The use of the maximum valve lift amount variable mechanism 3 as described below may be formed as the invention similar to the aforementioned embodiments. The maximum valve lift amount variable mechanism in which the maximum valve lift amount decreases as the displacement of the control shaft 32 toward the direction V1 and it increases as the displacement of the control shaft 32 toward the direction V2 may be employed to be formed as the invention similar to the embodiments.

The relationship between the maximum valve lift amount variable mechanism 3 and the variable valve timing mechanism 5 is not limited to the mode according to the first and the second embodiments. The aforementioned relationship may be an arbitrary mode so long as the control shaft 32 is associated with the advance oil passage such that the range in which the advance angle changes in accordance with the maximum valve lift amount is limited for the purpose of avoiding the contact between the piston and the engine valve.

The relationship between the maximum valve lift amount variable mechanism 3 and the variable valve timing mechanism 5 is not limited to the mode according to the first and the third embodiments. The aforementioned relationship may be an arbitrary mode so long as the control shaft 32 is associated with the advance oil passage such that the range in which the maximum valve lift amount changes in accordance with the advance angle is limited In the respective embodiments as aforementioned, the structure of the maximum valve lift amount variable mechanism 3 is not limited to the one as described above. The maximum valve lift amount variable mechanism is provided with the rocker shaft fixed to the engine, and a control shaft provided within the rocker shaft moveable along the axial direction so as to change the maximum valve lift amount through displacement of the control shaft in the axial direction.

The structure of the variable valve timing mechanism 5 is not limited to the one according to the embodiments. The variable valve timing mechanism of arbitrary type may be employed so long as it is structured to change the valve timing by adjusting the supply amount of the lubricant to the advance pressure chamber and the retardation pressure changer.

The invention is applied to the variable valve mechanism 1 in which the valve characteristics of the intake valve 14 is changed. However, the invention may be applied to the variable valve mechanism in which the valve characteristic of the exhaust valve is changed. The invention may be applied to the variable valve mechanism in which valve characteristics of both the intake and the exhaust valves.

The invention is applied to the variable valve mechanism in the engine of in-line-4-cyliner type. However, the invention may be applied to the variable valve mechanism of the engine of arbitrary type.

What is claimed is:

1. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of a work fluid supplied to the advance pressure chamber and the retardation pressure chamber, wherein:

the control shaft is associated with the advance oil passage such that the advance oil passage is held closed by the control shaft when the control shaft is held on a position at which the maximum valve lift amount of the engine valve is equal to or larger than a reference lift amount; and the advance oil passage is associated with the control shaft such that a control shaft operative range is limited to a range between a minimum value of the maximum valve lift amount and a lift amount just before the reference lift amount when an advance angle of the engine valve is equal to or larger than a reference advance angle.

2. The variable valve mechanism according to claim 1, wherein:

the maximum valve lift amount variable mechanism is provided on the rocker shaft, and includes a valve lift mechanism that operates the engine valve with a torque of a cam shaft of the engine, and an actuator linked with the control shaft so as to be driven;

the valve lift mechanism is provided on the rocker shaft swingably in a circumferential direction, and includes a slider gear moveable in the axial direction linked with the control shaft, an input arm provided on the slider gear so as to be driven by the cam shaft, and an output arm provided on the slider gear to lift the engine valve;

the slider gear has a helical spline at an input side in mesh with the input arm and a helical spline at an output side in mesh with the output arm, which has a tooth trace in an inclined direction opposite to that of a tooth trace of the helical spline at the input side; and a relative position between the slider gear and the input and output arms in the axial direction is changed by moving the control shaft by the actuator, and the maximum valve lift amount of the engine valve is changed through a relative rotation between the input arm and the output arm caused by the relative position that has been changed.

3. The variable valve mechanism for an engine according to claim 2, wherein:

the variable valve timing mechanism includes a vane rotor provided with a plurality of vanes, which is fixed to a cam shaft of the engine so as to be integrally rotated, and a housing provided with a plurality of bulkheads corresponding to the plurality of vanes, which is fixed to one of a pulley and a sprocket of the engine so as to be integrally rotated, in which the advance pressure chamber and the retardation pressure chamber are defined by the vane and the bulkheads; and a supply amount of the work fluid is adjusted to change a ratio of a capacity of the advance pressure chamber to that of the retardation pressure chamber so as to cause a relative rotation between the vane rotor and the housing, through which a valve timing of the engine valve is changed.

4. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of a work fluid supplied to the advance pressure chamber and the retardation pressure chamber, wherein:

the advance oil passage is closed by the control shaft when the maximum valve lift amount of the engine valve is equal to or larger than a reference lift amount, and the advance oil passage is opened by the control shaft when the maximum valve lift amount of the engine valve is smaller than the reference lift amount; and a control shaft operative range is limited to a range between a minimum value of the maximum valve lift amount and a lift amount just before the reference lift amount through a work fluid flowing in the advance oil passage when an advance angle of the engine valve is equal to or larger than a reference advance angle, and the limitation of the control shaft operative range through the work fluid is released when the advance angle of the engine valve is smaller than the reference advance angle.

5. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft;

a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber;

a first advance oil passage that connects an oil groove that is formed in the control shaft and forms a part of the advance oil passage to a first communication hole formed in the work fluid supply source and the rocker shaft;

a second advance oil passage that connects a second communication hole formed in the rocker shaft to the advance pressure chamber; and a lock mechanism for limiting a control shaft operative range, which includes a lock groove formed in the control shaft so as to extend in the axial direction, a restrictive oil passage that connects the first advance oil passage to a third communication hole formed in the rocker shaft, a lock pin provided in the restrictive oil passage and inserted into the lock groove through the third communication hole under depression force applied by the work fluid, and a bias mechanism provided in the restrictive oil passage so as to bias the lock pin to a direction opposite to a direction of the depression force applied by the work fluid, wherein:

a structure of a path through which the work fluid flows is selected between conditions [A] and [B] in accordance with an axial position of the control shaft, and a limitation of the control shaft operative range by the lock pin is selected between conditions [C] and [D] in accordance with an advance angle of the engine valve:

[A] when the control shaft is held on a position at which the maximum valve lift amount of the engine valve is smaller than a reference lift amount, an oil groove of the control shaft is communicated with the first and the second advance oil passages so as to maintain an opened state of the advance oil passage, and a communication state between the lock groove and the restrictive oil passage; and

[B] when the control shaft is held on a position at which the maximum valve lift amount is equal to or larger than the reference lift amount, the oil groove of the control shaft is not communicated with the first and the second communication holes so as to maintain a closed state of the advance oil passage, and a non-communication state between the lock groove and the restrictive oil passage;

[C] when an advance angle of the engine valve is equal to or larger than a reference advance angle, and the lock groove is communicated with the restrictive oil passage, a state in which the lock pin is inserted into the lock groove is maintained through the work fluid such that the control shaft operative range is limited to a range between a minimum value of the maximum valve lift amount and a lift amount just before the reference lift amount; and

[D] when the advance angle of the engine valve is smaller than the reference advance angle, a state in which the lock pin is not inserted into the lock groove is maintained through the bias mechanism such that the limitation of the control shaft operative range is released.

6. A variable valve mechanism for an engine, comprising a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the control shaft is associated with the advance oil passage such that the advance oil passage is held closed by the control shaft held on a position at which the maximum valve lift amount of the engine valve is equal to or larger than a reference lift amount.

7. The variable valve mechanism according to claim 6, wherein the variable valve mechanism is provided with a controller that changes the maximum valve lift amount under a control of the control shaft, and the controller inhibits a change in the maximum valve lift amount of the engine valve to be equal to or larger than an upper limit lift amount when an advance angle of the engine valve is equal to or larger than a reference advance angle.

8. A variable valve mechanism for an engine, comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the advance oil passage is brought into a closed state by the control shaft when the maximum valve lift amount of the engine valve is equal to or larger than a reference lift amount, and the closed state of the advance oil passage is released when the maximum valve lift amount of the engine valve is smaller than the reference lift amount.

9. The variable valve mechanism according to claim 8, wherein the variable valve mechanism is provided with a controller that changes the maximum valve lift amount under a control of the control shaft, and the controller inhibits a change in the maximum valve lift amount of the engine valve to be equal to or larger than an upper limit lift amount when an advance angle of the engine valve is equal to or larger than a reference advance angle.

10. A variable valve mechanism for an engine, comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber;

a first advance oil passage that connects an oil groove that is formed in the control shaft and forms a part of the advance oil passage to a first communication hole formed in the work fluid supply source and the rocker shaft; and a second advance oil passage that connects a second communication hole formed in the rocker shaft to the advance pressure chamber, wherein:

a structure of a path through which the work fluid flows is selected between conditions [A] and [B] in accordance with an axial position of the control shaft:

[A] when the control shaft is held on a position at which the maximum valve lift amount of the engine valve is smaller than the reference lift amount, an oil groove of the control shaft is communicated with the first and the second advance oil passages so as to maintain an opened state of the advance oil passage; and

[B] when the control shaft is held on a position at which the maximum valve lift amount is equal to or larger than the reference lift amount, the oil groove of the control shaft is not communicated with the first and the second communication holes so as to maintain a closed state of the advance oil passage.

11. The variable valve mechanism according to claim 10, wherein the variable valve mechanism is provided with a controller that changes the maximum valve lift amount under a control of the control shaft, and the controller inhibits a change in the maximum valve lift amount of the engine valve to be equal to or larger than an upper limit lift amount when an advance angle of the engine valve is equal to or larger than a reference advance angle.

12. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the control shaft is associated with the advance oil passage such that a control shaft operative range is limited to a range between a minimum value of the maximum valve lift amount and a lift amount just before a reference lift amount when an advance angle of the engine valve is equal to or larger than a reference advance angle.

13. The variable valve mechanism for an engine according to claim 12, wherein the variable valve mechanism is provided with a controller that changes the maximum valve lift amount under a control of the control shaft, and the controller inhibits a change in the advance angle of the engine valve to be equal to or larger than an upper limit advance angle when a maximum valve lift amount of the engine valve is equal to or larger than a reference lift amount.

14. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein a control shaft operative range is limited to a range between a minimum value of the maximum valve lift amount and a lift amount just before the reference lift amount through the work fluid that flows in the advance oil passage when an advance angle of the engine valve is equal to or larger than a reference advance angle, and a limitation of the control shaft operative range by the work fluid is released when the advance angle of the engine valve is smaller than the reference advance angle.

15. The variable valve mechanism for an engine according to claim 14, wherein the variable valve mechanism is provided with a controller that changes the maximum valve lift amount under a control of the control shaft, and the controller inhibits a change in the advance angle of the engine valve to be equal to or larger than an upper limit advance angle when a maximum valve lift amount of the engine valve is equal to or larger than a reference lift amount.

16. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber; and a lock mechanism for limiting a control shaft operative range, which includes a lock groove formed in the control shaft so as to extend in the axial direction, a restrictive oil passage that connects a first advance oil passage to the rocker shaft, a lock pin provided in the restrictive oil passage and inserted into the lock groove through a third communication hole under depression force applied by the work fluid, and a bias mechanism provided in the restrictive oil passage so as to bias the lock pin to a direction opposite to a direction of the depression force applied by the work fluid, wherein a control of a limitation of the control shaft operative range performed by the lock pin is selected between conditions [A] and [B] in accordance with an advance angle of the engine valve:

[A] when an advance angle of the engine valve is equal to or larger than a reference advance angle, and the lock groove is communicated with the restrictive oil passage, a state in which the lock pin is inserted into the lock groove is maintained by the work fluid so as to limit the control shaft operative range to a range between a minimum value (Lmin) of the maximum valve lift amount; and

[B] when the advance angle of the engine valve is smaller than the reference advance angle, a state in which the lock pin is not inserted into the lock groove is maintained by the bias mechanism, so as to release the limitation of the control shaft operative range.

17. The variable valve mechanism for an engine according to claim 16, wherein the variable valve mechanism is provided with a controller that changes the maximum valve lift amount under a control of the control shaft, and the controller inhibits a change in the advance angle of the engine valve to be equal to or larger than an upper limit advance angle when a maximum valve lift amount of the engine valve is equal to or larger than a reference lift amount.

18. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft, and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the advance oil passage is associated with the control shaft such that a range in which an advance angle of the engine valve is changed is limited in accordance with the maximum valve lift amount, and a range in which the maximum valve lift amount is changed is limited in accordance with the advance angle of the valve timing so as to avoid a contact between a piston of the engine and the engine valve.

19. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the advance oil passage is associated with the control shaft such that a range in which an advance angle of the engine valve is changed is limited in accordance with the maximum valve lift amount so as to avoid a contact between a piston of the engine and the engine valve.

20. A variable valve mechanism for an engine comprising:

a maximum valve lift amount variable mechanism which includes a rocker shaft fixed to the engine and a control shaft provided in the rocker shaft movably in an axial direction, and changes a maximum valve lift amount of an engine valve through an axial displacement of the control shaft; and a variable valve timing mechanism which includes an advance oil passage that connects a work fluid supply source and an advance pressure chamber, and a retardation oil passage that connects the work fluid supply source and a retardation pressure chamber, and changes a valve timing of the engine valve through an adjustment of an amount of the work fluid supplied to the advance pressure chamber and the retardation pressure chamber, wherein the advance oil passage is associated with the control shaft such that a range in which the maximum valve lift amount is changed is limited in accordance with an advance angle of the valve timing so as to avoid a contact between a piston of the engine and the engine valve.

* * * * *